US012060779B2

(12) United States Patent
Conzemius

(10) Patent No.: US 12,060,779 B2
(45) Date of Patent: Aug. 13, 2024

(54) SERVICE TOOL STRING WITH PERFORATING GUN ASSEMBLY POSITIONING TOOL

(71) Applicant: Halliburton Energy Services, Inc., Houston, TX (US)

(72) Inventor: Eric M. Conzemius, The Colony, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 186 days.

(21) Appl. No.: 17/683,639

(22) Filed: Mar. 1, 2022

(65) Prior Publication Data

US 2023/0003106 A1 Jan. 5, 2023

Related U.S. Application Data

(63) Continuation of application No. PCT/US2021/039940, filed on Jun. 30, 2021.

(51) Int. Cl.
*E21B 43/119* (2006.01)
*E21B 23/04* (2006.01)

(52) U.S. Cl.
CPC ..... *E21B 43/119* (2013.01); *E21B 23/042* (2020.05)

(58) Field of Classification Search
CPC ..... E21B 43/119; E21B 23/042; E21B 23/04; E21B 23/00; E21B 23/0419; E21B 47/095; E21B 43/112; E21B 47/09
See application file for complete search history.

(56) References Cited

U.S. PATENT DOCUMENTS 6,098,713 A 8/2000 Ross
6,926,089 B2 9/2005 Goodson, Jr. et al.
(Continued)

FOREIGN PATENT DOCUMENTS

EP 647767 A2 * 4/1995 ..... E21B 43/119
WO 2004063523 A1 7/2004
(Continued)

OTHER PUBLICATIONS

Foreign Communication from Related Application—United Kingdom Combined Search and Examination Report, Application No. GB 2207456.1, dated Oct. 27, 2022, 6 pages.
(Continued)

*Primary Examiner* — Tara Schimpf
*Assistant Examiner* — Yanick A Akaragwe
(74) *Attorney, Agent, or Firm* — Conley Rose, P.C.; Rodney B. Carroll

(57) ABSTRACT

A downhole tool position adjustment assembly for locating a tool downhole comprising a mandrel coupled to a housing via an extend-retract mechanism. A controller communicatively connected to the extend-retract mechanism, wherein an application executing within the controller, is configured to control the extend-retract mechanism. A communication system, communicatively coupled to the controller, is configured to receive a command signal from an operator at a surface location. The extend-retract mechanism moves the mandrel relative to the housing in response to a control signal received from the controller in response to the command signal received by the communication system.

28 Claims, 9 Drawing Sheets

(56) References Cited

U.S. PATENT DOCUMENTS

| | | | | |
|---|---|---|---|---|
| 8,016,026 | B2 | 9/2011 | Joseph | |
| 9,284,801 | B2 | 3/2016 | Maguire et al. | |
| 2008/0203199 | A1 | 8/2008 | Serafin et al. | |
| 2010/0224360 | A1 | 9/2010 | MacDougall et al. | |
| 2015/0072828 | A1 | 3/2015 | Reuter | |
| 2017/0275962 | A1* | 9/2017 | Conzemius | E21B 33/1272 |
| 2018/0133803 | A1 | 5/2018 | Karuppoor | |
| 2018/0179852 | A1 | 6/2018 | Hou et al. | |
| 2018/0209250 | A1 | 6/2018 | Daly et al. | |
| 2018/0274323 | A1 | 9/2018 | Arefi et al. | |
| 2018/0274331 | A1* | 9/2018 | Richards | E21B 43/045 |

FOREIGN PATENT DOCUMENTS

| | | | |
|---|---|---|---|
| WO | 2014065814 | A1 | 5/2014 |
| WO | 2015095571 | A1 | 6/2015 |
| WO | 2016182546 | A1 | 11/2016 |
| WO | 2018147857 | A1 | 8/2018 |

OTHER PUBLICATIONS

Foreign Communication from Related Application—International Search Report and Written Opinion of the International Searching Authority, International Application No. PCT/US2021/039940, dated Mar. 24, 2022, 12 pages.

* cited by examiner

SERVICE TOOL STRING WITH PERFORATING GUN ASSEMBLY POSITIONING TOOL

CROSS REFERENCE TO RELATED APPLICATIONS

This application is a Continuation of and claims priority to International Application No. PCT/US2021/039940 filed Jun. 30, 2021 and entitled, "Service Tool String with Perforating Gun Assembly Positioning Tool," which is incorporated by reference herein in its entirety.

BACKGROUND

Well servicing operations can be performed in wellbores extending far from surface with challenging wellbore geometry such as horizontal sections, deviated sections, and sections with multiple direction changes. Well servicing tools can be lowered from a servicing rig at surface on a work string to a desired or target position in the well. The location of the well servicing tools with respect to a target depth may be difficult to determine due to the wellbore geometry. The location of the well servicing tools can be determined with well surveying tool, but such tools require additional trips into and out of the wellbore adding delay and associated expense. In certain work strings having a retrievable service packer, the up and down manipulation of the work string to anchor the well servicing tools with the retrievable service packer within the target depth can move well servicing tools out of position. There is a need to reposition well servicing tools to a correct position after the service packer has been set and without the aid of a separate surveying tool.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

Figure 1:
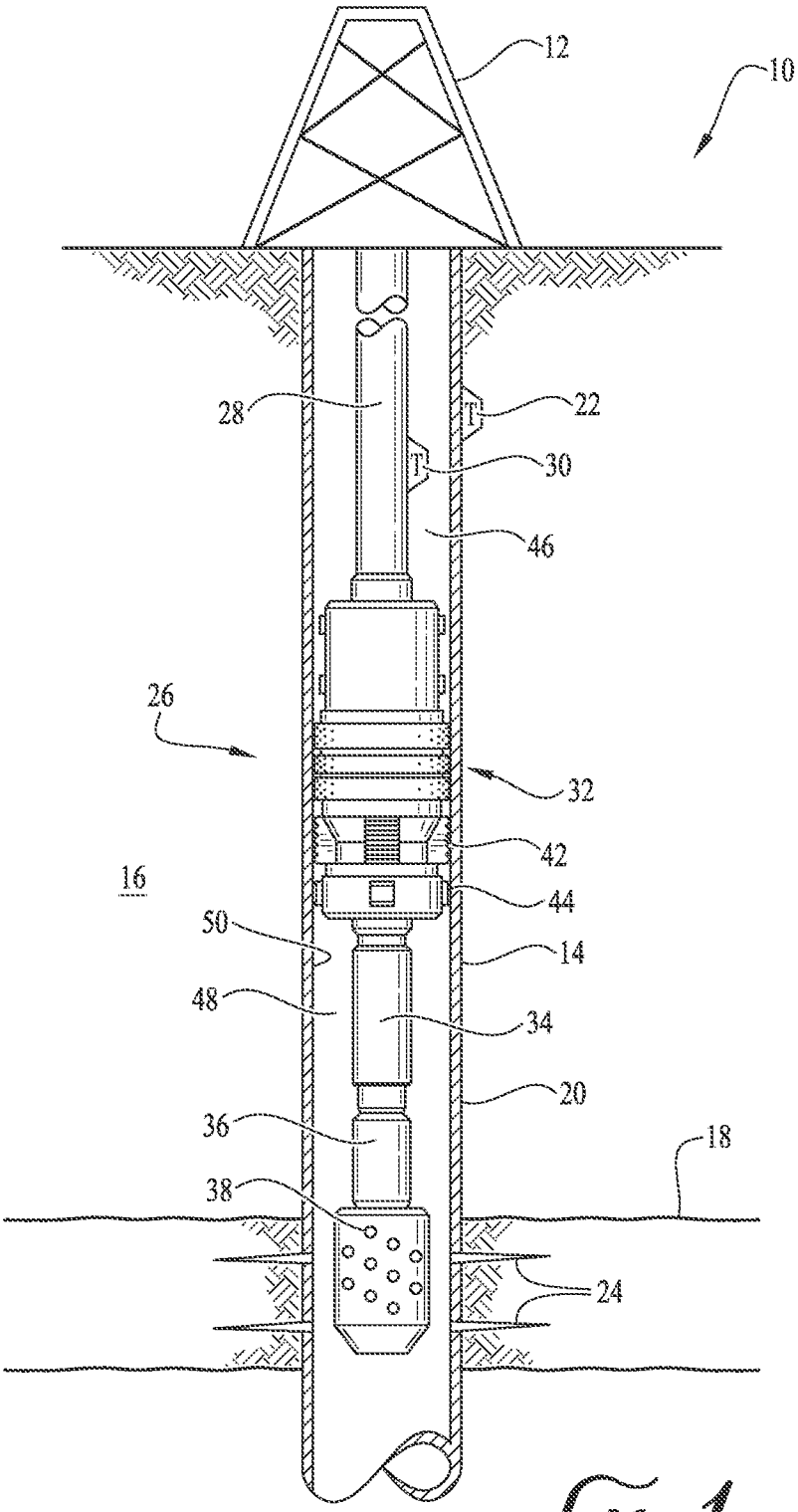
FIG. 1 is a schematic view of a wellbore environment showing an embodiment of the downhole adjustment tool assembly.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Service companies routinely lower well servicing tools into the wellbore to perform treatment operations on oil and gas wells. The typical well servicing tools can include retrievable service packers, reservoir testing tools, and perforating equipment. These well servicing tools can be attached to a work string such as coil tubing, production tubing, or drill pipe to be lowered into the wellbore from equipment (rig, platform, etc.) located at an onshore or offshore surface above the well. Well servicing tools can require work string manipulation (e.g., raising, lowering, or rotation) to activate, perform the operation, and deactivate for retrieval from the well. Operations deep within the wellbore can inhibit movement of the tool string to actuate or manipulate the well servicing tools. The wellbore geometry of extended horizontal wellbores, deviated wellbores, and wellbores with multiple changes in directions can result in high friction forces between the inner surface of the casing and the work string. The combination of high friction forces and changes of wellbore direction can cause the well servicing tools to move up and down in a jerky motion, e.g., motion with sudden starts and stops, and generally appear "sticky" at surface. The sudden start and stops of the well servicing tool can inhibit and generally prevent the accurate placement of the perforating guns. In some cases, the motion of the work string can prevent the setting of a service packer at a desired location resulting in the perforating guns to being out of position. In some cases, the target zone can be relatively small in length, e.g., small target zone, resulting in considerable amount of time spent to locate the perforating guns in the target zone. In some cases, the target zone can be located in a deviated wellbore that is difficult to determine the position of the tool string. Perforating the wellbore in the wrong position or partially in the wrong position can inhibit or prevent the production of the desired formation fluids, e.g., oil and gas. The service packer may need to be unset, repositioned, and reset to place the perforating gun into the correct position. The additional manipulation of the work string can cause unwanted delays and increase the risk of an adverse event. A perforating gun assembly positioning method is needed.

One solution of positioning perforating guns at a desired position is to utilize an adjustment tool that can move the perforating guns independent of the service packer. In an embodiment, the service tool string can include a positioning tag, a service packer, an adjustment tool, and a perforating gun assembly. The work string can lower the service tool string to an estimated target depth. The depth of the formation can be determined by a casing survey and one or more logging runs. The depth of the service tool string can be estimated by correlating the measured length of the work string to the casing survey. Lowering the service tool string to an estimated target depth may place the perforating gun assembly within or close to a target zone. The target zone can be a distance along the casing where the casing intersects the formation with the desired hydrocarbons, also referred to as the production zone or pay zone. The target zone can be the depth where the production zone begins, e.g., intersects the casing, to the depth the production zone ends. The perforating guns on the service tool string can perforate the casing and cement within the target zone to allow the desired hydrocarbons to enter the casing and be produced to surface. The target depth for the service tool string with perforating guns and an adjustment tool can be a distance that includes the length of the target zone, e.g., the depth the production zone begins and ends, and the adjustment length of the adjustment tool. A tag locating tool can be conveyed into the work string on wireline to locate the tag on the service tool string and a casing tag or other reference point having a known location within the wellbore, and provide a measurement of the location of the two tags. The depth of the service tool string can be determined by the location of the casing tag and the distance from the casing tag to the tag on the service tool string. The service tool string can be repositioned if the service tool string is not within the target depth. The tag locating tool can remeasure the distance between tags after the service tool string has been repositioned. If the service tool string is located within the target depth, a signal can be sent from surface down the work string to the adjustment tool. The adjustment tool can have an initial length, e.g., the assembled length or run-in length. The adjustment tool can lengthen (e.g., extend from an initial length to a longer length), retract (e.g., retract from an initial length to a shorter length), or both, to change the location of the perforating gun assembly and move the perforating gun assembly to the desired location. In some embodiments, the adjustment tool can extend and/or retract from an initial length (e.g., a run-in length), from a first intermediate length (a length associated with a firing of a first perforating gun), from a second intermediate length (a length associated with a firing of a second perforating gun), and/or to final length (e.g., a run-out length) to change the location of the perforating gun assembly. The service packer on the service tool string can be set with work string manipulation. The adjustment tool can send a location confirmation signal back to surface. The perforating guns can perforate the casing. The work string can then unset the packer and retrieve the packer, adjustment tool, and the spent perforating gun assembly.

Another solution to position the perforating gun assembly at the desired depth, e.g., target depth, is to utilize an adjustment tool with an anchoring mechanism to set the service packer. The adjustment tool can provide a precise location of the perforating guns for short production zones, e.g., production zones with a short distance between the beginning depth of the zone and the ending depth of the zone. The adjustment tool can include an anchoring mechanism that anchors the perforating guns to the casing so that the adjustment tool can extend to actuate the slips, e.g., anchoring the slips to the casing, of the service packer so that the service tool string doesn't move to set the service packer. In an embodiment, the service tool string can include a positioning tag, a service packer, an adjustment tool with an anchoring system, and a perforating gun assembly. The work string can lower the service tool string to the estimated target depth. A tag locating tool can be lowered into the work string on wireline to locate the tag on the service tool string and a casing tag or other indicator of a reference point having a known location within the wellbore, and provide a measurement of the location of the two tags. The work string can be manipulated to reposition the service tool string with the perforating gun assembly. The tag locating tool can remeasure the distance between tags. If the service tool string is within the target depth, a signal can be sent from surface down the work string to the adjustment tool. The adjustment tool with the anchoring mechanism can activate the anchoring mechanism to anchor the adjustment tool, and thereby anchor the perforating gun assembly, to the casing. The adjustment tool, while anchored to the casing, can extend to compress the bottom of the service packer and set the slips on the service packer. The work string can be lowered to fully set, e.g., anchor and seal, the service packer. After the packer is set, the anchoring system on the adjustment tool can be deactivated and the adjustment tool can lengthen or shorten to change the location of the perforating gun assembly while the packer remains set and stationary. The adjustment tool can send a confirmation signal back to surface. The perforating guns can perforate the casing. The work string can then unset the packer and retrieve the packer, adjustment tool, and the spent perforating gun assembly.

In an embodiment, the adjustment tool for changing the location of the perforating gun assembly can include a mechanism for axial and/or rotational orientation of the perforating gun assembly that orients the perforating gun to a desired direction. In addition, the setting module can be activated independent of the adjustment tool (e.g., without moving the adjustment tool) or can be activated dependent on the adjustment tool (e.g., by movement of the adjustment tool).

Turning now to FIG. 1, a wellbore operating environment 10 in which a service tool string can be deployed is described. The wellbore operating environment 10 comprises a servicing rig 12 that extends over and around a wellbore 14 that penetrates a subterranean formation 16 for the purpose of recovering hydrocarbons from one or more production zones 18. The wellbore 14 can be drilled into the subterranean formation 16 using any suitable drilling technique. While shown as extending vertically from the surface, the wellbore 14 can also be deviated, horizontal, and/or curved over at least some portions of the wellbore 14. The wellbore 14 can also include one or more lateral wellbores drilled off of the primary wellbore 14. The wellbore 14 can be cased, open hole, contain tubing, and a casing 20 can be placed in the wellbore 14 and secured at least in part by cement. The casing 20 can include a casing tag 22 or other location reference point indicator, e.g., a radioactive tag, housed within a coupling or a housing at a predetermined distance from surface. A wellbore 14 can include one or more production zones 18 with perforations 24.

The servicing rig 12 can be one of a drilling rig, a completion rig, a workover rig, a coil tubing rig, an offshore platform or ship, or other structure and supports a toolstring 26 disposed in the wellbore 14. In other embodiments, other surface systems or structures can also support the toolstring 26. The servicing rig 12 can also comprise a derrick with a rig floor through which the toolstring 26 extends downward from the servicing rig 12 into the wellbore 14. In some cases, such as in an offshore location, the servicing rig 12 can be supported by piers extending downwards to a seabed. Alternatively, the servicing rig 12 can be supported by columns sitting on hulls and/or pontoons that are ballasted below the water surface, which can be referred to as a semi-submersible platform or floating rig. In deep water applications, the servicing rig 12 can be supported by a drillship. In an offshore location, a casing 20 can extend from the servicing rig 12 to the ocean floor to exclude sea water and contain drilling fluid returns. It is understood that mechanical mechanisms known to those in the arts can control the run-in and withdrawal of the toolstring 26 in the wellbore 14, for example a draw works coupled to a hoisting apparatus, another servicing vehicle, a coiled tubing unit and/or other apparatus.

In an embodiment, a well servicing toolstring 26 can include a conveyance string or work string 28, a location tag 30, a service packer 32, an adjustment tool 34, an anchoring mechanism 36, and a perforating gun assembly 38. The work string 28 can be any of a string of jointed pipes, a coiled tubing, and a wireline. For example, the work string 28 can be drill pipe, production tubing, workover tubing, or any type of threaded tubing. The term "location tag" as used herein includes any suitable type of indicator that can be associated with (e.g., affixed at) (i) a given component (e.g., tool to wellbore completion component) and/or (ii) a known location or reference point in the wellbore and subsequently located or interrogated by an interrogator/reader device in order to provide an indication of the location of the interrogator/reader device relative to (i) the position of the given component and/or (ii) the known location or reference point within the wellbore. For example, in one scenario, the location tag 30 can be a radioactive pellet contained within a radioactive marker sub, e.g., a coupling or housing. In a second scenario, the location tag 30 can be a radioactive coating, e.g., paint, applied to the inner bore or outer surface of one or more tools, e.g., a coupling or housing. In a third scenario, the work string 28 could have a restriction, e.g., reduced inner surface or removable ball, that could be located with a wireline run. The casing 20 could have a restriction, e.g., a reduced inner surface, that the well servicing toolstring 26 can locate, e.g., cannot pass through. The service packer 32 can be a retrievable packer that sets and unsets by work string 28 manipulation. The anchoring mechanism 36 can be coupled to the adjustment tool 34. The adjustment tool 34 can be coupled to the service packer 32. The perforating gun assembly 38 can be coupled to the adjustment tool 34. In some embodiments, the anchoring mechanism 36 can be omitted.

The service packer 32 can be a retrievable packer comprising a sealing element, a set of slips 42, and a drag block assembly 44. The set of slips 42 can releasably anchor the service packer 32 to the inner surface 50 of the casing 20. The drag block assembly 44 can include a plurality of spring loaded pads that slidingly engage the inner surface 50 of the casing 20. A packer actuation assembly, coupled to the drag block assembly 44, can configure the service packer 32 into the run-in position or the set position. The packer actuation assembly comprises a limiting mechanism to restrict or allow the service packer 32 to set from manipulation of the work string 28, e.g., up and down motion. The packer actuation assembly can comprise a lug, also called a pin or key, within a j-slot. One or more lugs can be coupled to a rotator ring. The j-slot can be a simple j-slot with two positions or a continuous j-slot with multiple positions. The packer actuation assembly can restrict the service packer 32 to the run-in position, e.g., un-set position, with the lug in a first position within the j-slot. The packer actuation assembly can allow the service packer 32 to actuate, e.g., set position, with the lug in a second position within the j-slot. The activation assembly can control the activation, e.g., retain or deployment of the set of slips 42. Upward movement of the work string 28 can move the packer actuation assembly to the set position. Downward movement of the work string 28 can activate the set of slips 42 to grip the inner surface 50 of the casing 20. After the slips 42 are set, the work string 28 can be lowered to apply weight and compress the sealing elements to form a seal against the inner surface 50 of the casing 20. The service packer 32 can anchor and seal to the casing 20 to isolate the upper annulus 46 from the lower annulus 48. The service packer 32 can include additional features such as an internal valve, a pressure equalizing mechanism, and a second anchoring mechanism.

The perforating gun assembly 38 may be of conventional design which may comprise a plurality of explosive devices (e.g., perforating charges or shaped charges) disposed within a gun body that are evenly radially distributed, e.g., 360 degrees, and detonated in order to perforate the casing, e.g., perforations 24 in casing 20. The perforating gun assembly 38 may include elements such as a charge carrier, a detonation cord coupled to each perforating charge. The perforating gun assembly 38 may be coupled to the adjustment tool 34, the anchoring mechanism 36, or a combination of the two. The perforating gun assembly 38 may include an apparatus, e.g., firing head, to fire the perforating charges. The perforating gun assembly 38 can comprise 1, 2, 3, or any number of perforating gun sections that can be individually fired. The perforating gun assembly 38 can perforate a production zone, e.g., 18, for each perforating gun section. Alternatively, the perforating gun assembly 38 can include one or more gun sections with radially oriented perforating charges, e.g., perforating charges pointing to a single position on a compass, i.e. zero degrees. The radially oriented perforating charges can perforate a production zone, e.g., production zone 18, in a single direction, e.g., zero degrees. For example, in one scenario, one or more downhole tools, e.g., a pressure gauge, may be located at 180 degrees, so the production zone 18 can be perforated with radially oriented perforating changes that can be oriented at zero degrees. In another scenario, the production zone 18 may fracture along a fault plane oriented at zero degrees and 180 degrees. The radially oriented perforating charges can perforate the production zone 18 with charges oriented to zero degrees and 180 degrees.

The adjustment tool 34 can comprise a mandrel coupled to a housing by an extend-retract mechanism. The extend-retract mechanism can be communicatively coupled with a controller. The controller can receive a command signal (also referred to as a surface signal or a surface command signal) transmitted by the service personnel at surface. The mandrel can be extended by the extend-retract mechanism via control signals sent from the controller. In some embodiments, the extend-retract mechanism, via the controller, can extend and/or retract the mandrel. The adjustment tool 34 can reposition the perforating gun assembly coupled to the mandrel by extending and/or retracting the mandrel.

In some embodiments, the adjustment tool 34 can comprise an anchoring mechanism 36 to anchor the adjustment tool 34 and the perforating gun assembly 38 to the casing 20. The anchoring mechanism 36 can be activated via control signals sent from the controller. The adjustment tool 34 can activate the anchoring mechanism 36 then extend the mandrel coupled to a housing by the extend-retract mechanism to anchor the set of slips 42 of the service packer 32 to the inner surface 50 of the casing 20.

The toolstring 26 can be conveyed into the wellbore 14 by a work string 28. The toolstring 26 can be lowered to the approximate target depth. A locating tool run can determine an accurate location of the toolstring 26. After the toolstring 26 is located at the target depth, a command signal can be sent from surface. The controller, on the adjustment tool 34, can receive the command signal and send a control signal the extend-retract mechanism to actuate and thereby extend and/or retract the mandrel, per the instructions within the command signal, to place the perforating gun assembly within the target zone. The service packer can be set, the perforation guns fired, and the service packer released and retrieved to surface.

Figure 2:
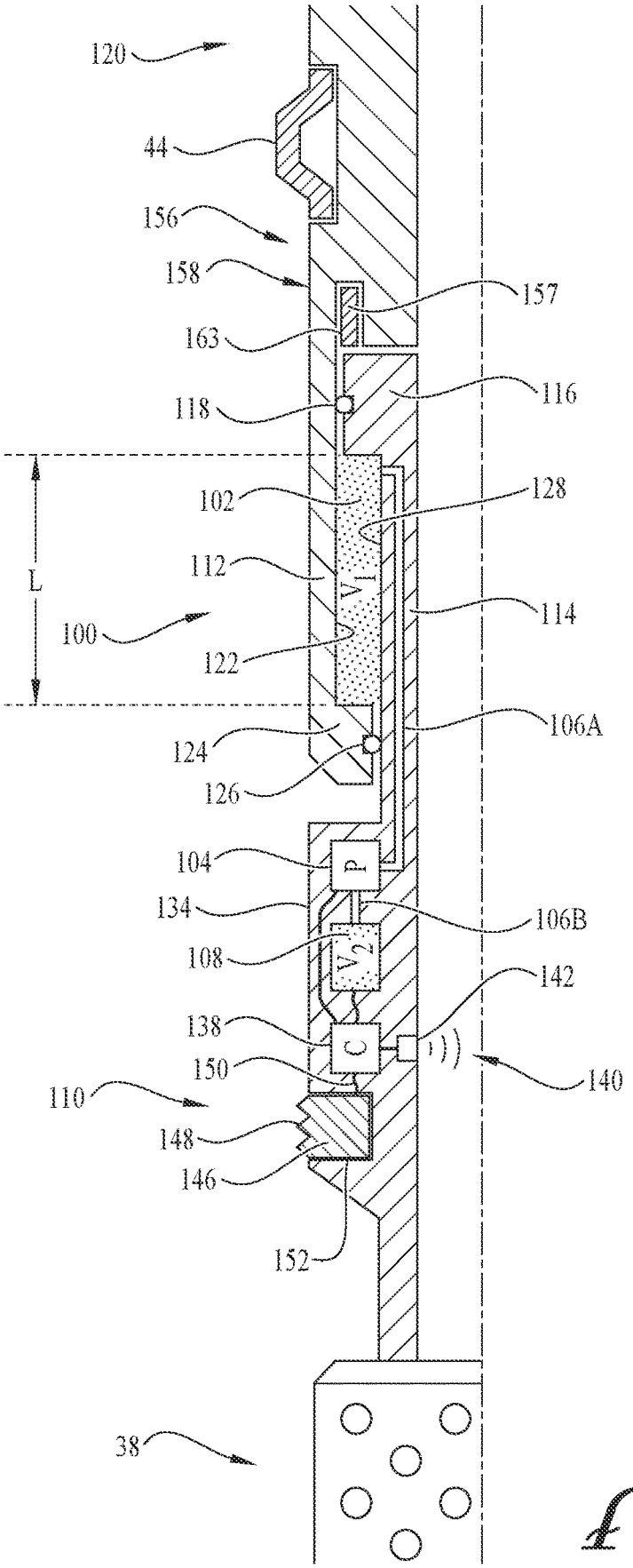
FIG. 2 is a partial sectional view of an adjustment tool and activation tool according to an embodiment of the present invention.

In a first configuration, the adjustment tool 34 can be configured to retain the service packer in the run-in position, unlock the service packer for actuation, and reposition the perforating gun assembly 38 into a target zone. The adjustment tool 34 can be configured with a mandrel that is held in the fully retracted position by an extend-retract mechanism that comprises a hydraulic system with a trapped volume of fluid and a pump. The service packer 32 can be retained in a run-in position by a feature deactivated by the adjustment tool 34. Turning now to FIG. 2, an embodiment of the adjustment tool 100 includes an extend-retract mechanism with a hydraulic system comprising a trapped volume of fluid and a pump 104. The hydraulic system can comprise a first chamber 102, a fluid path 106, a pump 104, and second chamber 108. The fluid can be a generally incompressible fluid such as hydraulic fluid, hydraulic oil, transmission fluid, or similar fluid. The first chamber 102 can be formed by a housing 112 with a generally cylindrical shape with a sliding fit on a mandrel 114. The mandrel 114, with a generally cylindrical shape, can include a piston 116 and a seal assembly 118. The housing 112 can be threadingly coupled to the service packer 120 and form the first chamber 102 with an inner surface 122 and an end sub 124 with a seal assembly 126. The seal assembly 126 and seal assembly 118 can comprise a single O-ring, a double O-ring, back-up rings, rubber molded seal ring, energized seal rings, thermoplastic seal rings, or any combination thereof. The seal assembly 126 can sealingly engage the outer surface 128 of the mandrel 114. The seal assembly 118 can sealingly engage the inner surface 122 of the housing 112. The adjustment tool 100 can extend the mandrel 114 all or a portion of a distance labeled L, the adjustment length, which is the distance the piston 116 can move within the housing 112 to the end sub 124. The mandrel 114 couples to a control sub 134 and fluidly connects a first fluid path 106A to the pump 104. The control sub 134 comprises the pump 104, a second fluid path 106B, the second chamber 108, a controller 136, and a communication system 140. The second fluid path fluidly connects the pump 104 to the second chamber 108. The second chamber 108 can include a fluid expansion method such as a bladder, a set of bellows, a balance piston, a port to the annulus 48, or combination thereof. The weight of the perforating gun assembly 38 pressurizes the fluid within the chamber 102 via the piston 116. The weight of the perforating gun assembly 38 transfers to the piston 116 via the mandrel 114, the control sub 130, and the anchoring mechanism 110. The controller 138 can comprise a printed circuit board, a transceiver, a microprocessor, non-transitory memory, and an application executing in memory. The application executing in non-transitory memory can include instructions stored therein, e.g., the application, defining the operation of the adjustment tool 100. The controller 138 can include a power source such as one or more batteries or ultracapacitors. The controller 138 can be communicatively coupled to the pump 104 and the communication system 140, which can be configured for wired or wireless communication with an operator at the surface. For example, the communication system 140 can transmit acoustic signals up the wellbore through a column of fluid. The communication system 140 can include a battery, electronics, and a signal generator 142. The control, or alternately the electronics in the communication system 140, can be disposed to generate and transmit an acoustic signal with a suitable acoustic signal generator 142, for example, one or more piezoelectric elements. The signal generator 142 can be a transceiver configured to receive acoustic signals, e.g., a microphone, or to send acoustic signals, e.g., a speaker. The signal generator 142 can send a confirmation signal after the successful completion of each step in the positioning procedure. The acoustic signal can travel up the column of fluid in the wellbore for receipt by an acoustic signal receiver, e.g., a microphone. The electronics in the communications system 140 may include one or more batteries in addition to or in place of the one or more batteries in the controller 138. In an aspect, the signal generator 142 can be a mud pulse generator. The controller 138, alternately the communication system 140 can be disposed to generate and transmit mud pulses or dynamic changes the pressure of the fluid column.

In an alternate embodiment, a downhole position adjustment assembly comprising a mandrel 114 coupled to a housing 112 by an extension-retraction mechanism. A controller 138 communicatively connected to the extension-retraction mechanism, wherein a control application, executing in non-transitory memory on the controller 138, is configured to control the extension-retraction mechanism. A communication system 140, communicatively connected to the controller 138, is configured to receive a surface signal. The extend-retract mechanism moves the mandrel 114 relative to the housing 112 in response to a control signal received from the controller 138 in response to the surface signal received by the communication system 140.

The service packer, e.g., 32 in FIG. 1, can include a feature that is unlocked by the adjustment tool 100. In an embodiment, the service packer 120 comprises a packer actuation assembly 156 that includes a lug lock 158 that restricts the lug 157 to a first position within the j-slot 163 and thereby restricts the service packer 120 to the run-in position. The piston 116 of the adjustment tool 100 can abut the lug lock 158 and retain the lug lock 158 in a first position that restricts the lug to a first position while the adjustment tool 100 is in the run-in position. The movement of the piston 116, e.g., extending the mandrel 114 of the adjustment tool 100 from an initial position, can release the lug lock 158 to move to a second position and thereby release the lug from the first position of within the j-slot.

The operational sequence of locating the perforating gun assembly within the target zone with the service packer 120, adjustment tool 100, and perforating gun assembly 38 of FIG. 2, is described. In an embodiment, the service packer 120 can be held in the run-in position by the lug lock 158 of the packer actuation assembly 156. The toolstring 26 can be conveyed on the work string 28 to an estimated target depth, e.g., the predetermined depth based on a target zone of the formation to be perforated by the perforating gun assembly 38. The tag locating tool can be conveyed into the work string 28 to verify the location of the toolstring 26. The toolstring 26 can be repositioned, e.g., moved up or down, by the work string 28, to place the toolstring 26 at the target depth such that the adjustment tool 100 can position the perforating gun assembly 38 within the target zone. If the toolstring 26 is located at the target depth, e.g., the perforating gun assembly 38 is located within, or can be repositioned to, the production zone 18, the procedure can continue to the next step.

The service packer 120 can be unlocked by movement of the adjustment tool 100. The adjustment tool 100 retains the service packer 120 in the run-in position via the packer actuation assembly 156. An acoustic signal can be transmitted from surface to the signal generator 142 that is configured to listen, i.e., receive signals. The controller 138 may stroke, e.g., linearly move, the adjustment tool 100 a portion of the adjustment length L. The first position of the adjustment tool 100 that releases the lug lock 158 may be a fraction of the overall stroke length L of the adjustment tool 100. For example, the adjustment tool 100 may move the piston a short distance, e.g., 6 inches, to release the lug lock 158 and allow the lug to transfer out of a first position within the j-slot. The signal generator 142 can send a confirmation signal after the successful completion of each step in the positioning procedure. After the packer actuation assembly 156 is released, the procedure can move to the next step.

The adjustment tool 100 can move the perforating gun assembly 38 to the target zone. The measurement from the tag locating tool can provide the distance for the adjustment tool 100 to stroke, e.g., extend or retract the mandrel 114. A second acoustic signal can be transmitted from surface to the signal generator 142 that is configured to listen, i.e., receive signals. Alternatively, the controller 138 can continue the operation of the adjustment tool 100 from the previous step. The controller 138 may stroke, e.g., linearly move, the adjustment tool 100 all or a portion of the adjustment length L to place the perforating guns at a predetermined desired location. The controller 138 strokes the adjustment tool 100 by activating the pump 104 via the instructions from the signal received by the signal generator 142. The pump 104 can transfer fluid from chamber 102 to chamber 108 via fluid path 106A and 106B. The weight of the perforating gun assembly 38 extends the adjustment tool 100 as fluid is removed from the chamber 102. In response to a control signal, extension-retraction mechanism actuates to extend or retract the mandrel by transferring fluid to a chamber by the pump 104. The position of the mandrel 114 can be determined by the pump 104 measuring the volume of fluid transferred, by a flow sensor measuring the volume of fluid transferred, by a linear transducer measuring a linear distance, or a combination thereof. The linear transducer can be located inside the chamber 102, on the outer surface 128 of the mandrel 114, between the housing 112 and the control sub 134, or inside the chamber 108. The signal generator 142 can send a confirmation signal after the successful completion of this step. After the perforating gun assembly 38 is placed within the target zone, the procedure can move to the next step.

The service personnel at surface may set the service packer 120 with work string 28 manipulation. The lug lock 158 of the packer actuation assembly 156 may place the lug into the second j-track position so that the service packer 32 sets with downward movement of the work string 28. After the service packer has been set, the procedure can move to the next step.

In an embodiment, the service personnel at surface may deploy the tag locating tool on wireline within the work string 28 to correlate the location tag 30 to the casing tag 22 a second time to determine the location of the perforating gun assembly 38. The service personnel may signal the controller 138 of the adjustment tool 100 to extend or retract the piston 116 to a third position that moves the perforating gun assembly 38 to the target zone, e.g., the predetermined depth of the production zone. After the perforating gun assembly has been placed in the target zone, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

In a second configuration, the adjustment tool can include an anchoring mechanism to retain the perforating gun assembly at a target depth while the service packer is set. The anchoring mechanism can retain the perforation gun assembly within a short production zone while the service tool is actuated. The adjustment tool with the anchoring mechanism can be configured with a mandrel that is held in the fully retracted position by the same extend-retract mechanism described above. Returning to FIG. 2, an embodiment of the adjustment tool with an anchoring mechanism includes an extend-retract mechanism with a hydraulic system comprising a trapped volume of fluid and a transfer pump 104. The anchoring mechanism 110 can be coupled to the control sub 134 of the adjustment tool 100. The anchoring mechanism 110 can comprise a plurality of deployable anchors 146 with an outer surface 148, and a control cable 150. The control cable 150 can be communicatively coupled to the controller 138. The deployable anchor 146 can be a plurality of cylinder shapes with a sliding fit inside a plurality of deployment cylinders 152. The deployable anchor 146 can include a permanent magnet installed within the base. The deployment cylinder 152 can include an electromagnet within the bottom abutting the deployable anchor 146 and the permanent magnet. The controller 138 can provide a signal, e.g., power and voltage, to the electromagnet in the bottom of the deployment cylinder 152 to attract the deployable anchor 146 during the installation, e.g., run-in, of the toolstring 26. The controller 138 can provide a signal to the electromagnet within the deployment cylinder 152 to repel the permanent magnet and subsequently extend the deployable anchor 146. The repelling force provided by the electromagnet acting on the bottom of the deployable anchors 146 can force the deployable anchors 146 to anchor against the inner surface 50 of the casing 20. The outer surface 148 of the deployable anchor 146 can include a sharp profiled surface to bite or anchor into the casing, e.g., the casing 20 in FIG. 1. The outer surface 148 can include a sharp profiled surface can be teeth with a hardened knife edge, ceramic buttons, or an attachable profile. Alternatively, the outer surface 148 can have a profile that matches the curvature of the inner surface 50 of the casing 20 and a material that provides a friction fit, for example a brake pad or elastomeric material. Alternatively, the deployable anchor 146 can include a seal assembly at sealingly engage the inner surface of the deployment cylinder 152. The deployment cylinder 152 can be fluidly connected to the pump 104. The controller 138 can signal the pump 104 to provide pressure and volume of fluid to extend the plurality of deployable anchors 146 from the deployment cylinders 152. The fluid pressure provided by the pump 104 acting on the bottom of the deployable anchors 146 can force the deployable anchors 146 to anchor against the inner surface 50 of the casing 20.

The operational sequence of locating the perforating gun assembly within the target zone with the service packer 120, adjustment tool 100 with the anchoring mechanism 110, and perforating gun assembly 38 of FIG. 2, is described. The toolstring 26 can be conveyed on the work string 28 to an estimated target depth, e.g., the predetermined depth based on a target zone of the formation to be perforated by the perforating gun assembly 38. The tag locating tool can be conveyed into the work string 28 to verify the location of the toolstring 26. The toolstring 26 can be repositioned, e.g., moved up or down, by the work string 28, to place the toolstring 26 at the target depth such that the adjustment tool 100 can position the perforating gun assembly 38 within the target zone. If the toolstring 26 is located at the target depth, e.g., the perforating gun assembly 38 is located within, or can be repositioned to, the production zone 18, the procedure can continue to the next step.

The service packer 120 can be unlocked by movement of the adjustment tool 100. The adjustment tool 100 retains the service packer 120 in the run-in position via the packer actuation assembly 156. An acoustic signal can be transmitted from surface to the signal generator 142 that is configured to listen, i.e., receive signals. The controller 138 may stroke, e.g., linearly move, the adjustment tool 100 a portion of the adjustment length L. For example, the adjustment tool 100 may move the piston a short distance, e.g., 6 inches, to release the lug lock 158 and allow the lug to transfer out of a first position within the j-slot. The signal generator 142 can send a confirmation signal after the successful completion of each step in the positioning procedure. After the service packer 120 is unlocked, the procedure can move to the next step.

The adjustment tool 100 can move the perforating gun assembly 38 to the target zone. The measurement from the tag locating tool can provide the distance for the adjustment tool 100 to stroke, e.g., extend or retract the mandrel 114. A second acoustic signal can be transmitted from surface to the signal generator 142 that is configured to listen, i.e., receive signals. Alternatively, the controller 138 can continue the operation of the adjustment tool 100 from the previous step. The controller 138 may stroke, e.g., linearly move, the adjustment tool 100 all or a portion of the adjustment length L to place the perforating guns at a predetermined desired location. The controller 138 strokes the adjustment tool 100 by activating the pump 104 via the instructions from the signal received by the signal generator 142. The pump 104 can transfer fluid from chamber 102 to chamber 108 via fluid path 106A and 106B. The weight of the perforating gun assembly 38 extends the adjustment tool 100 as fluid is removed from the chamber 102. In response to a control signal, extension-retraction mechanism actuates to extend or retract the mandrel by transferring fluid to a chamber by the pump 104. The position of the mandrel 114 can be determined by the pump 104 measuring the volume of fluid transferred, by a flow sensor measuring the volume of fluid transferred, by a linear transducer measuring a linear distance, or a combination thereof. The linear transducer can be located inside the chamber 102, on the outer surface 128 of the mandrel 114, between the housing 112 and the control sub 134, or inside the chamber 108. The signal generator 142 can send a confirmation signal after the successful completion of this step. After the perforating gun assembly 38 is placed within the target zone, the procedure can move to the next step.

The anchoring mechanism 110 coupled to the adjustment tool 100, can anchor the perforating gun assembly 38 within the target zone, e.g., the production zone to be perforated, and actuate the slips 42 of the service packer 120. The controller 138 may continue a preprogrammed method, or may receive a third signal from surface to continue with this step. The controller 138 may signal the deployment cylinder 152 to extend the deployable anchors 146. The controller 138 may provide power and voltage to an electromagnet to extend the deployable anchors 146 to grip the inner surface 50 of the casing 20 as illustrated in FIG. 1. Alternately, the controller 138 may signal the pump 104 to supply fluid to the deployment cylinder 152 with volume and pressure to extend the deployable anchors 146 and grip the inner surface 50 of the casing 20. After the deployable anchors 146 anchor the perforating gun assembly 38 to the target depth, the procedure can move to the next step.

The adjustment tool 100 can extend to move the bottom of the service packer 120 upwards to set the slips 42 into the casing 20. The controller 138 may continue a preprogrammed method, or may receive a fourth signal from surface to continue with this step. The controller 138 may activate the pump 104 to transfer fluid from the chamber 102 to chamber 108 via the fluid path 106A and 106B. The transfer of fluid may subsequently move the packer actuation assembly 156 and drag block assembly 44 of the service packer 120 uphole, e.g., towards the surface, to extend the slips 42 to the inner surface 50 of the casing 20. The signal generator 142 can send a confirmation signal after the successful completion of this step. The service personnel at surface can move the work string 28 downhole, e.g., towards the bottom of the wellbore, to apply weight to the service packer 120 to anchor the slips 42 and compress the sealing elements to seal against the inner surface 50 of the casing 20. The service personnel at surface may signal the adjustment tool 100 from surface to deactivate the deployable anchors 146 of the anchoring mechanism 110. After the service packer 120 has been set, the procedure can move to the next step.

In an embodiment, the service personnel at surface may deploy the tag locating tool on wireline within the work string 28 to correlate the location tag 30 to the casing tag 22 a second time to determine the location of the perforating gun assembly 38. The service personnel may signal the controller 138 of the adjustment tool 100 to extend or retract the piston 116 to a third position that moves the perforating gun assembly 38 to the target position, e.g., the predetermined depth of the production zone. After the perforating gun assembly has been placed in the target zone, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Although one method of setting the service packer 120 is disclosed, the service packer 120 may be set, e.g., activated to anchor and seal to the casing 20, by other methods. For example, in a first scenario, the adjustment tool 100 can set the slips and sealing elements on the service packer 120. The adjustment tool 100 can unlock the packer actuation assembly 156, position the perforating gun assembly 38, deploy the deployable anchors 146 from the anchoring mechanism 110, extend the adjustment tool 100 to extend the slips and compress the sealing elements of the service packer 120 to seal and anchor to the inner surface 50 of the casing 20. The service personnel may move the work string 28 downwards to increase the sealing capacity of the sealing elements of the service packer 120. In a second scenario, the service packer 120 can be configured with a second set of slips above the sealing element. The adjustment tool 100 can unlock the packer actuation assembly 156, position the perforating gun assembly 38, deploy the deployable anchors 146 from the anchoring mechanism 110, extend the adjustment tool 100 to move the service packer 120 upwards to extend the upper slip assembly to anchor to the inner surface 50 of the casing 20. The service personnel may move the work string 28 upwards to compress the sealing elements against the upper slips that are anchored to the casing 20. In a third scenario, the service packer 120 can be set with downward movement of the work string 28. The adjustment tool 100 can unlock the packer actuation assembly 156, position the perforating gun assembly 38, deploy the deployable anchors 146 from the anchoring mechanism 110, extend the adjustment tool 100 to lift the drag block assembly 44 to move the lug to a second position within the j-slot. The downward movement of the work string 28 by the service personnel can anchor the slips 42 to the inner surface 50 of the casing 20 and compress the sealing elements to seal to the inner surface 50 of the casing 20. In a fourth scenario, the service packer 120 can be set with work string 28 manipulation. The adjustment tool 100 can unlock the packer actuation assembly 156 and position the perforating gun assembly 38. The service packer 120 can be set, e.g., activated, by work string 28 manipulation, e.g., moving the work string 28 upwards and downwards. The upward movement can move the lug to a second position within the j-slot. The downward movement of the work string 28 by the service personnel can anchor the slips 42 to the inner surface 50 of the casing 20 and compress the sealing elements to seal to the inner surface 50 of the casing 20.

Figure 3A:
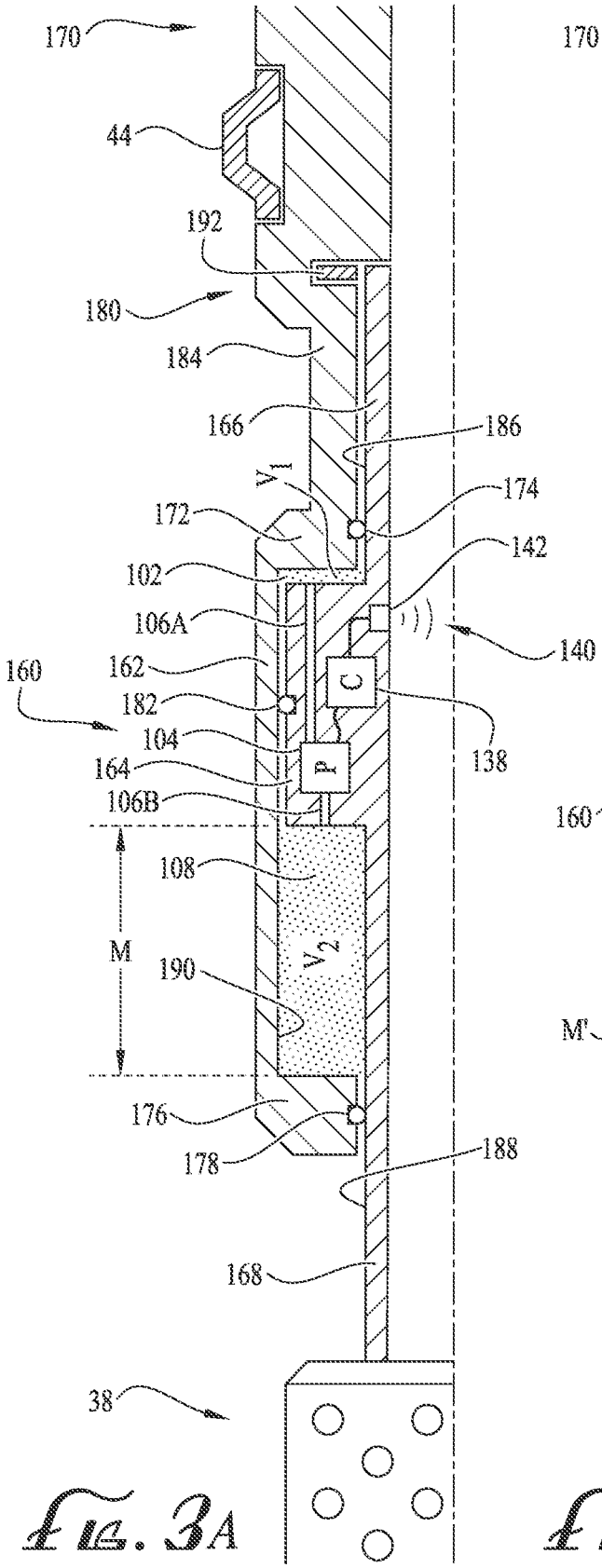
FIG. 3A-B are partial sectional views of an adjustment tool according to another embodiment of the present invention.
Figure 3B:
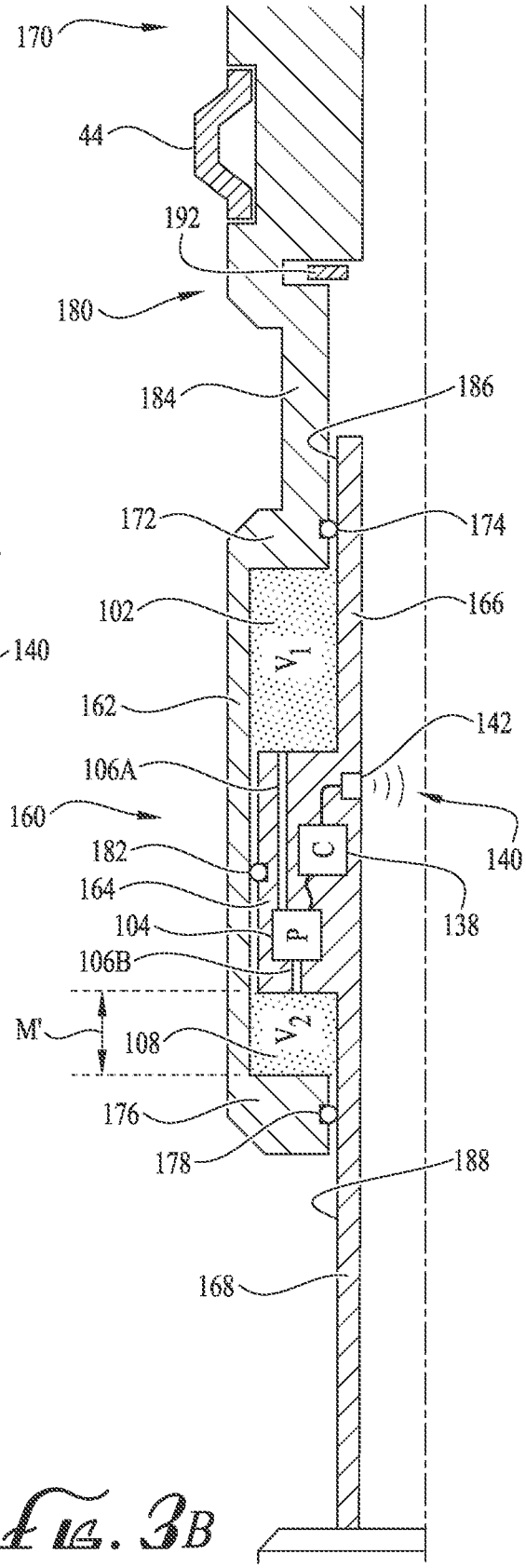

In a third configuration, the adjustment tool 34 can be configured to retain the service packer in the run-in position, unlock the service packer for actuation, and reposition the perforating gun assembly 38 into a target zone. The adjustment tool 34 can be configured with a mandrel that is held in the fully retracted position by an extend-retract mechanism that comprises a hydraulic system with a trapped volume of fluid and a pump. The adjustment tool 34 can extend and retract the mandrel with the extend-retract mechanism. The service packer 32 can be retained in a run-in position by a feature deactivated by the adjustment tool 34. Turning now to FIGS. 3A and 3B, an embodiment of the adjustment tool 34 includes an extend-retract mechanism with a hydraulic system comprising a trapped volume of fluid within two balanced chambers and a transfer pump 104. In this embodiment, adjustment tool 160 includes features in common with adjustment tool 100 shown in FIG. 2, and thus, shared features are labeled similarly. The trapped volume of fluid can include a first chamber 102, a fluid path 106, a transfer pump 104, and second chamber 108. The fluid can be a generally incompressible fluid such as hydraulic fluid, hydraulic oil, transmission fluid, or similar fluid. The first chamber 102 and second chamber 108 can be formed by a housing 162 with a generally cylindrical shape with a sliding fit with a piston 164. The piston 164, with a generally cylindrical shape, can include an upper mandrel 166, a lower mandrel 168, and a seal assembly 182. The housing 162 can include an upper end sub 172, an upper seal assembly 174, a lower end sub 176, a lower seal assembly 178. A connector sub 184 can be coupled to the upper end sub 172 and the service packer 170. The seal assembly 174, 178, and 182 can comprise a single O-ring, a double O-ring, back-up rings, rubber molded seal ring, energized seal rings, thermoplastic seal rings, or any combination thereof. The seal assembly 174 can sealingly engage the outer surface 186 of the upper mandrel 166. The seal assembly 178 can sealingly engage the outer surface 188 of the lower mandrel 168. The seal assembly 182 can sealingly engage the inner surface 190 of the housing 162. The adjustment tool 160 can be configured in a run-in position wherein the second chamber 108 is filled with hydraulic fluid and the piston 164 abuts the upper end sub 172. The adjustment tool 160 can extend the lower mandrel 168 a distance labeled M, the adjustment length, which is the distance the piston 164 can move within the housing 162 to contact the lower end sub 176. The piston 164 comprises the pump 104, a first fluid path 106A, a second fluid path 106B, a controller 136, and a communication system 140. The first fluid path 106A fluidly connects the first chamber 102 to the pump 104. The second fluid path 106B fluidly connects the pump 104 to the second chamber 108. The second chamber 108 can include a fluid expansion method such as a bladder, a set of bellows, a balance piston, a port to the annulus 48, or combination thereof. The weight of the perforating gun assembly 38 pressurizes the fluid within the second chamber 108 via the piston 164. The weight of the perforating gun assembly 38 transfers to the piston 164 via the lower mandrel 168 and the piston 164. The controller 138 can comprise a printed circuit board, a transceiver, a microprocessor, non-transitory memory, and an application executing in memory. The application executing in non-transitory memory can include instructions stored therein, e.g., the application, defining the operation of the adjustment tool 160. The controller 138 can include a power source such as one or more batteries or ultracapacitors. The controller 138 can be communicatively coupled to the pump 104 and the communication system 140. The communication system 140 can transmit acoustic signals up the wellbore through a column of fluid after the completion of each step. The communication system 140 can include a battery, electronics, and a signal generator 142. The controller 138, or alternately the electronics in the communication system 140, can be disposed to generate and transmit an acoustic signal with a signal generator 142, for example, one or more piezoelectric elements. The signal generator 142 can be a transceiver configured to receive acoustic signals, e.g., a microphone, or to send acoustic signals, e.g., a speaker. The acoustic signal can travel up the column of fluid in the wellbore for receipt by an acoustic signal receiver at surface, e.g., a microphone. The electronics in the communications system 140 may include one or more batteries in addition to or in place of the one or more batteries in the controller 138. In an aspect, the signal generator 142 can be a mud pulse generator. The controller 138, alternately the communications system 140 can be disposed to generate and transmit mud pulses or dynamic changes the pressure of the fluid column.

The service packer, e.g., 32 in FIG. 1, can include a feature that is unlocked by the adjustment tool 160. In an embodiment, the service packer 170 comprises a packer actuation assembly 180 that that includes a lug lock 158 that restricts the lug to a first position within the j-slot and thereby restricts the service packer 120 to the run-in position. The piston 116 of the adjustment tool 100 can abut the lug lock 158 and retain the lug lock 158 in a first position that restricts the lug to a first position while the adjustment tool 100 is in the run-in position. The movement of the piston 116, e.g., extending the mandrel 114 of the adjustment tool 100 from an initial position, can release the lug lock 158 to move to a second position and thereby release the lug from the first position of within the j-slot.

The operational sequence of locating the perforating gun assembly within the target zone with the service packer 170, adjustment tool 160, and perforating gun assembly 38 of FIGS. 3A and 3B, is described. In an embodiment, the service packer 170 can be held in the run-in position by the block release 192 of the packer actuation assembly 180. The toolstring 26 can be conveyed on the work string 28 to an estimated target depth, e.g., the predetermined depth based on a target zone of the formation to be perforated by the perforating gun assembly 38. The tag locating tool can be conveyed into the work string 28 to verify the location of the toolstring 26. The toolstring 26 can be repositioned, e.g., moved up or down, by the work string 28, to place the toolstring 26 at the target depth such that the adjustment tool 100 can position the perforating gun assembly 38 within the target zone. If the toolstring 26 is located at the target depth, e.g., the perforating gun assembly 38 is located within, or can be repositioned to, the production zone 18, the procedure can continue to the next step The service packer 170 can be unlocked by movement of the adjustment tool 160. The adjustment tool 160 retains the service packer 170 in the run-in position via the packer actuation assembly 180. A first acoustic signal can be transmitted from surface to the signal generator 142 that is configured to listen, i.e., receive signals. The controller 138 may receive a signal and may stroke, e.g., linearly move, the adjustment tool 160 a portion of the adjustment length M in response to the signal. For example, the controller 138 may stroke the adjustment tool 160 to a first position that releases block release 192 of the packer actuation assembly 180. The signal generator 142 can transmit an acoustic signal after each step is completed. After the packer actuation assembly 180 is released, the procedure can move to the next step.

The service packer 170 can be set by one of the following methods. The packer actuation assembly 180 releases a block release 192 that moves the lug into a second position within the j-slot and moving the work string 28 downwards sets the service packer 170, e.g., anchors the slips 42 and seals the sealing elements to the casing 20. The packer actuation assembly 180 releases a block release 192 that moves the lug into a first j-slot and moving the work string 28 upwards transfers the lug to the second position so that moving the work string 28 downwards sets the service packer 170. The packer actuation assembly 180 releases a valve, e.g., block release 192) that opens a port that floods an atmospheric chamber with wellbore fluid that releases the lug into a second position in the j-slot and moving the work string 28 downwards sets the service packer 170. After the service packer 170 is set, the procedure can move to the next step.

The adjustment tool 160 can be positioned into a second position that places the perforating gun assembly 38 into the target zone. A measurement from the tag locating tool can provide the distance for the adjustment tool 160 to stroke, e.g., extend or retract the mandrel 114. A second acoustic signal can be transmitted from surface to the signal generator 142 that is configured to listen, i.e., receive signals. The controller 138 may receive the signal and may stroke, e.g., linearly move, the adjustment tool 160 a portion of the adjustment length M in response to the signal. In response to a control signal, extension-retraction mechanism actuates to extend or retract the mandrel by transferring fluid to a chamber by the pump 104. In this scenario, the controller 138 may stroke the adjustment tool 160 from an initial position to a second position to locate the perforation gun assembly within the target zone.

The controller 138 strokes the adjustment tool 160 by activating the pump 104 via the instructions from the signal received by the signal generator 142. The pump 104 can transfer fluid from chamber 102 to chamber 108 via fluid path 106A and 106B. The pump 104, in addition to the weight of the perforating gun assembly 38, determines the pressure in chamber 108. The adjustment tool 160 extends the lower mandrel 168 as fluid is removed from the chamber 108 and transferred to chamber 102. The adjustment tool 160 retracts the lower mandrel 168 as fluid is transferred, e.g., pumped into, chamber 108 from chamber 102. The position of the mandrel 168 can be determined by the pump 104 measuring the volume of fluid transferred, by a flow sensor measuring the volume of fluid transferred, by a linear transducer measuring a linear distance, or a combination thereof. The linear transducer can be located inside the chamber 102, on the outer surface 188 of the lower mandrel 168, between the upper mandrel 166 and the service packer 170, or inside the chamber 108. The signal generator 142 can transmit an acoustic signal after this step is completed.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Figure 4A:
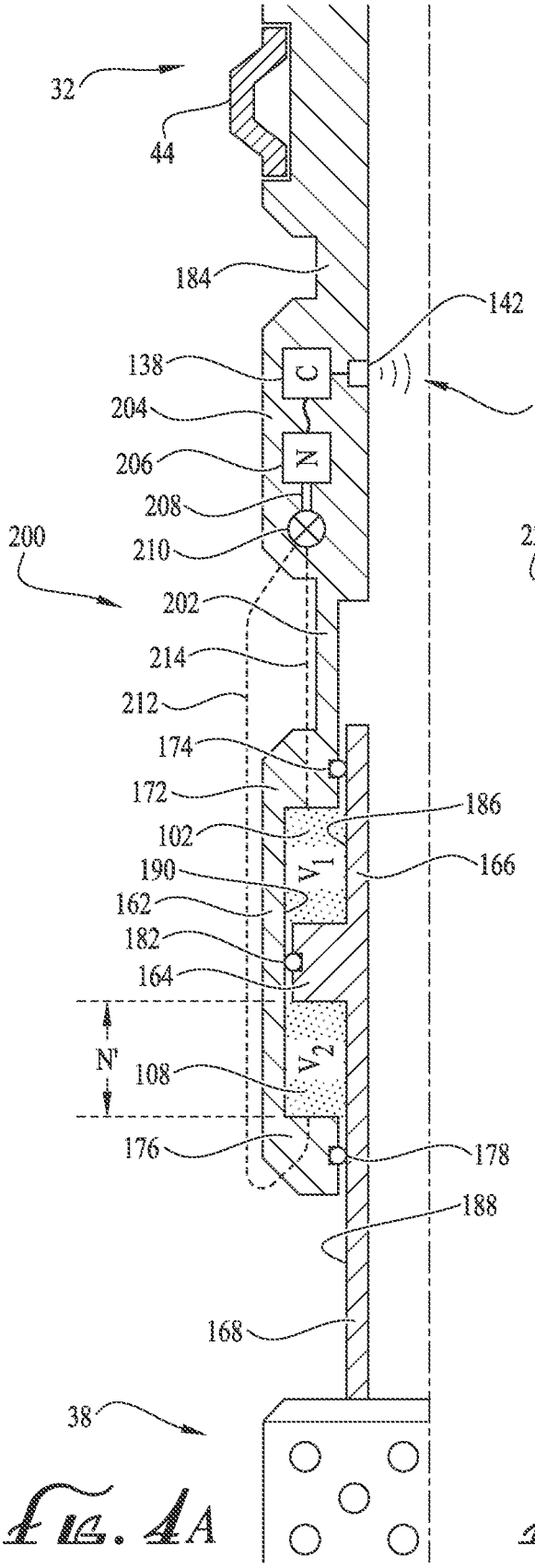
FIG. 4A-B are partial sectional views of an adjustment tool according to still another embodiment of the present invention.

In a fourth configuration, the adjustment tool can be configured with an extend-retract mechanism that utilizes a single pressure source and a manifold. The adjustment tool may be configured with two balanced chambers that receive a pressure charge from a single source to extend from an initial position to a second position. Turning now to FIG. 4A, an embodiment of the adjustment tool 34 comprising an extend-retract mechanism with a single pressure source and a manifold is described. In this embodiment, adjustment tool 200 includes features in common with adjustment tool 100 shown in FIG. 2 and adjustment tool 160 in FIGS. 3A and 3B, and thus, shared features are labeled similarly. The adjustment tool 200 can comprise a trapped volume of fluid, a contained pressure source, and a manifold 210. The trapped volume of fluid can include a second chamber 108, a fluid path, e.g., control line 212, and the manifold 210. The fluid can be a generally incompressible fluid such as hydraulic fluid, hydraulic oil, transmission fluid, or similar fluid. The first chamber 102 and second chamber 108 can be formed by a housing 162 with a generally cylindrical shape with a sliding fit with a piston 164. The piston 164, with a generally cylindrical shape, can include an upper mandrel 166, a lower mandrel 168, and a seal assembly 182. The housing 162 can include an upper end sub 172, an upper seal assembly 174, a lower end sub 176, and a lower seal assembly 178. The seal assemblies 174, 178, and 182 can comprise a single O-ring, a double O-ring, back-up rings, rubber molded seal ring, energized seal rings, thermoplastic seal rings, or any combination thereof. The seal assembly 174 can sealingly engage the outer surface 186 of the upper mandrel 166. The seal assembly 178 can sealingly engage the outer surface 188 of the lower mandrel 168. The seal assembly 182 can sealingly engage the inner surface 190 of the housing 162. The adjustment tool 200 can be configured in a run-in position wherein the second chamber 108 is filled with hydraulic fluid and the piston 164 abuts the upper end sub 172. The adjustment tool 200 can extend the lower mandrel 168 a distance labeled N, the adjustment length, which is the distance the piston 164 can move within the housing 162 to contact the lower end sub 176. The adjustment tool 200 is illustrated in a mid-stroke, or partially extended, position with a distance labeled N' in FIG. 4A. The cylinder 162 can be coupled to a control sub 204 via a connector sub 202. The control sub 204 can be coupled to the service packer 32 via a connector sub 184. The control sub 204 comprises the manifold 210, a bleed port, a nitrogen gas source 206, a first fluid path 208, a controller 136, and a communication system 140. The first fluid path 208 fluidly connects the nitrogen gas source 206 the manifold 210. The nitrogen gas source 206 can be a compressed volume of gas. A first control line 214 fluidly connects the first cylinder 102 to the manifold 210. The manifold 210 comprises a plurality of valves that fluidly connect the first cylinder 102 and the second cylinder 108 to one of the nitrogen source 206, a bleed port, a fluid stop, or combination thereof. The bleed port fluidly connects the manifold to a port to the annulus 48. During the run-in of the toolstring 26, the second chamber 108 is filled with hydraulic fluid. The weight of the perforating gun assembly 38 pressurizes the fluid within the second chamber 108 via the piston 164. The weight of the perforating gun assembly 38 transfers to the piston 164 via the lower mandrel 168. The manifold 210 can be configured to close the cylinder 108 and control line 212 with a fluid stop to maintain the fluid pressure within the chamber 108. The controller 138 can comprise a printed circuit board, a transceiver, a microprocessor, non-transitory memory, and an application executing in memory. The application executing in non-transitory memory can include instructions stored therein, e.g., the application, defining the operation of the adjustment tool 160. The controller 138 can include a power source such as one or more batteries or ultracapacitors. The controller 138 can be communicatively coupled to the manifold 210 and the communication system 140. As previously described, the communication system 140 can be configured to receive and transmit acoustic signals via the wellbore.

The operational sequence of locating the perforating gun assembly within the target zone with the service packer 32, adjustment tool 200, and perforating gun assembly 38 of FIG. 4A, is described. In an embodiment, the service packer 32 comprises a packer actuation assembly that can restrict or allow the service packer 32 to set, or actuate, and anchor and seal against the casing. The toolstring 26 can be conveyed on the work string 28 to a predetermined depth based on a target formation to be perforated by the perforating gun assembly 38. As previously described, the tag locating tool can determine the location of toolstring 26 relative to the target zone. If the toolstring 26 is located within the target depth, the procedure can move to the next step.

The adjustment tool 200 can be actuated to place the perforating gun assembly 38 within the target zone. The adjustment tool 200 can be configured in a run-in position, e.g., a non-stroked position, during run-in of the toolstring 26. An acoustic signal can be transmitted from surface to the signal generator 142 that is configured to listen, i.e., receive signals. The controller 138 may stroke, e.g., linearly move, the adjustment tool 200 a portion of the adjustment length N in response to the signal. For example, the controller 138 may stroke the adjustment tool 200, to a position labeled N' in FIG. 4A, to locate the perforating gun assembly 38 to the target position. In response to a control signal, extension-retraction mechanism actuates to extend or retract the mandrel by transferring fluid, e.g., nitrogen, from a nitrogen source 206 to a chamber by the manifold 210. The controller 138 can extend the adjustment tool 200 by configuring one or more valves within the manifold 210 via the instructions from the signal received by the communication system 140. The manifold 210 can transfer fluid from chamber 108 to the annulus 48 via the bleed port as nitrogen is transferred from the nitrogen source 206 to the chamber 102 via the line 208, the manifold 210, and the control line 214. The controller 138 can retract the adjustment tool 200 by configuring one or more valves within the manifold 210 to bleed fluid, e.g., nitrogen, from the chamber 102 as nitrogen pressure from the nitrogen source 206 is transferred to the chamber 108. The manifold 210 may set one or more valves to transfer the fluid, e.g., nitrogen, from chamber 102 to the annulus 48 via the control line 214, the manifold 210 and the bleed port. The manifold 210 may set one or more valves to transfer the fluid, e.g., nitrogen or hydraulic fluid, from nitrogen source 206 to chamber 108. The controller 138 may obtain data from one or more pressure sensors fluidly connected to the nitrogen source 206, the chamber 108, and the chamber 102. The pressure sensors may be directly connected or fluidly connected via the manifold 210, control line 212, control line 214, and line 208. The position of the mandrel 168 can be determined by the pressure sensors measuring the pressure of fluid within the chamber 108 and the chamber 102, by a linear transducer measuring a linear distance, or a combination thereof. The linear transducer can be located inside the chamber 102, on the outer surface 188 of the lower mandrel 168, between the upper mandrel 166 and the service packer 170, or inside the chamber 108. The controller 138 can send a confirmation signal to surface via the communication system 140. After the perforating guns 38 are located within the target zone, the procedure can move to the next step.

The service personnel at surface may set the service packer 32 with work string 28 manipulation. The upward motion of the work string 28 can move the lug from a first position to a second j-track position so that the service packer 32 sets with downward movement of the work string 28. After the service packer has been set, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Figure 4B:
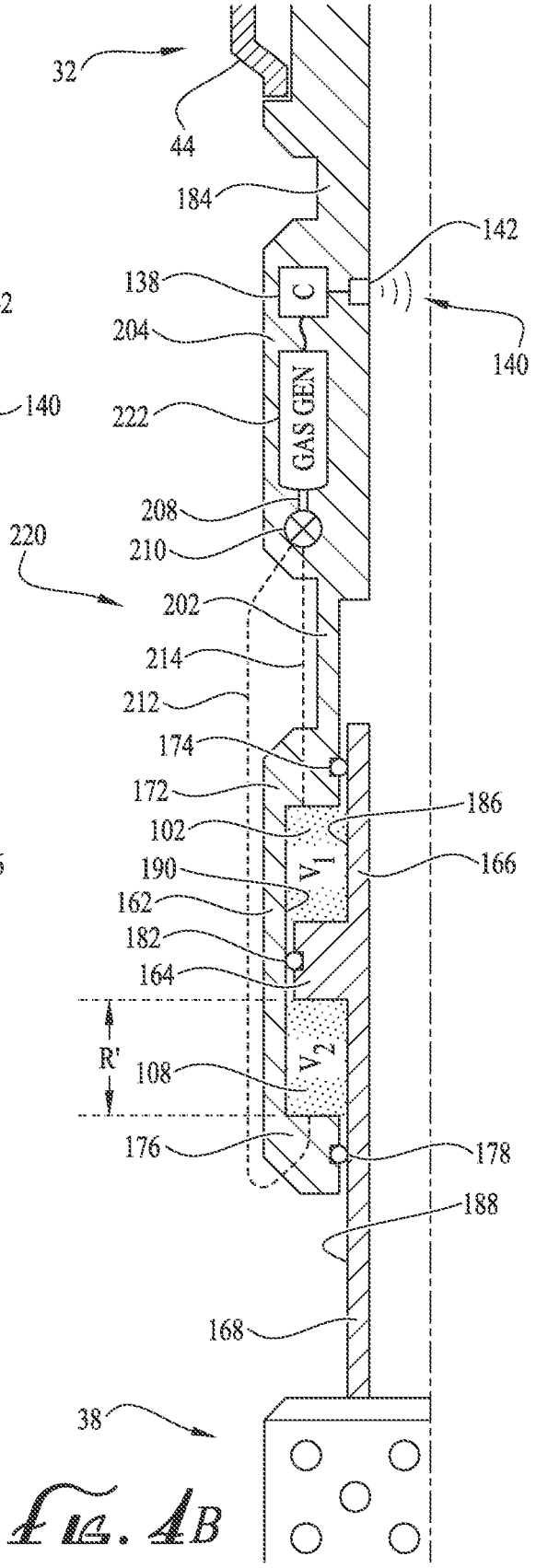

In a fifth configuration, the adjustment tool can be configured with an extend-retract mechanism that utilizes a generated pressure source and a manifold. The adjustment tool may be configured with two balanced chambers that receive a pressure charge from a gas pressure generator to extend from an initial position to a second position. Turning now to FIG. 4B, an embodiment of the adjustment tool 34 comprising an extend-retract mechanism with a gas generator and a manifold is described. In this embodiment, adjustment tool 220 includes features in common with adjustment tool 200 shown in FIG. 4A and adjustment tool 160 in FIGS. 3A and 3B, and thus, shared features are labeled similarly. The adjustment tool 220 can comprise a trapped volume of fluid, a gas pressure generator 222, and a manifold 210. The trapped volume of fluid can include a second chamber 108, a fluid path, e.g., control line 212, and the manifold 210. The fluid can be a generally incompressible fluid such as hydraulic fluid, hydraulic oil, transmission fluid, or similar fluid. The first chamber 102 and second chamber 108 can be formed by a housing 162 with a generally cylindrical shape with a sliding fit with a piston 164. The piston 164, with a generally cylindrical shape, can include an upper mandrel 166, a lower mandrel 168, and a seal assembly 182. The housing 162 can include an upper end sub 172, an upper seal assembly 174, a lower end sub 176, and a lower seal assembly 178. The seal assemblies 174, 178, and 182 can comprise a single O-ring, a double O-ring, back-up rings, rubber molded seal ring, energized seal rings, thermoplastic seal rings, or any combination thereof. The seal assembly 174 can sealingly engage the outer surface 186 of the upper mandrel 166. The seal assembly 178 can sealingly engage the outer surface 188 of the lower mandrel 168. The seal assembly 182 can sealingly engage the inner surface 190 of the housing 162. The adjustment tool 220 can be configured in a run-in position wherein the second chamber 108 is filled with hydraulic fluid and the piston 164 abuts the upper end sub 172. The adjustment tool 220 can extend the lower mandrel 168 a distance labeled R, the adjustment length, which is the distance the piston 164 can move within the housing 162 to contact the lower end sub 176. The adjustment tool 200 is illustrated in a mid-stroke, or partially extended, position with a distance labeled R' in FIG. 4B. The cylinder 162 can be coupled to a control sub 204 via a connector sub 202. The control sub 204 can be coupled to the service packer 32 via a connector sub 184. The control sub 204 comprises the manifold 210, a bleed port, a gas generator 222, a first fluid path 208, a controller 136, and a communication system 140. The first fluid path 208 fluidly connects the gas generator 222 the manifold 210. The gas generator 222 can produce gas of a sufficient quantity of pressure and volume to actuate the adjustment tool 220. The gas generator 222 can be configured to produce gas from a chemical reaction or from combusting a fuel source. The gas generator 222 can be configured to segregate a catalyst, e.g., copper or iron sulphate, from a reactant, e.g., hydrogen peroxide. The gas generator 222 can be configured to mix the hydrogen peroxide with the copper/iron sulphate when activated by controller 136 to produce an exothermic reaction with oxygen and water as the products of the reaction. The gas pressure, e.g., oxygen, can be held within the reaction chamber or transferred via the manifold 210 to one of the cylinders, e.g., cylinder 108 or 102. The gas generator 222 can be configured to combust a fuel source, for example, a pyrotechnic charge. The gas generator 222 can utilize a pyrotechnic or "black power" charge (e.g., a charge similar to a road flare) to develop a high pressure gas within a firing chamber with the ignition of the pyrotechnic charge. The high pressure generated by the burning or firing of the pyrotechnic charge can be held within the gas generator 222 or transferred via the manifold 210 to one of the cylinders, e.g., cylinder 108 or 102. By "burning" or "firing" it is meant the continuous generation, sometimes relatively slowly, of pressure by ignition of a power charge initiated reaction which results in a pressure increase within a firing chamber of transmittable gaseous pressure within the apparatus. The gas generator 222 can comprise a single chamber or a plurality of chambers that produce gas on a as needed basis. A first control line 214 fluidly connects the first cylinder 102 to the manifold 210. The manifold 210 comprises a plurality of valves that fluidly connect the first cylinder 102 and the second cylinder 108 to one of the gas generator 222, a bleed port, a fluid stop, or combination thereof. The bleed port fluidly connects the manifold to a port to the annulus 48. During the run-in of the toolstring 26, the second chamber 108 is filled with hydraulic fluid. The weight of the perforating gun assembly 38 pressurizes the fluid within the second chamber 108 via the piston 164. The weight of the perforating gun assembly 38 transfers to the piston 164 via the lower mandrel 168. The manifold 210 can be configured to close the cylinder 108 and control line 212 with a fluid stop to maintain the fluid pressure within the chamber 108. The controller 138 can comprise a printed circuit board, a transceiver, a microprocessor, non-transitory memory, and an application executing in memory. The application executing in non-transitory memory can include instructions stored therein, e.g., the application, defining the operation of the adjustment tool 160. The controller 138 can include a power source such as one or more batteries or ultracapacitors. The controller 138 can be communicatively coupled to the manifold 210 and the communication system 140. As previously described, the communication system 140 can be configured to receive and transmit acoustic signals via the wellbore.

The operational sequence of locating the perforating gun assembly within the target zone with the service packer 32, adjustment tool 220, and perforating gun assembly 38 of FIG. 4B, is described. In an embodiment, the service packer 32 comprises a packer actuation assembly that can restrict or allow the service packer 32 to set, or actuate, and anchor and seal against the casing. The toolstring 26 can be conveyed on the work string 28 to a predetermined depth based on a target formation to be perforated by the perforating gun assembly 38. As previously described, the tag locating tool can determine the location of toolstring 26 relative to the target zone. If the toolstring 26 is located within the target depth, the service packer 170 can be set, e.g., actuated to anchor to the casing 20, with work string 28 manipulation.

The adjustment tool 220 can be configured in a run-in position, e.g., a non-stroked position, during run-in of the toolstring 26. An acoustic signal can be transmitted from surface to the signal generator 142 that is configured to listen, i.e., receive signals. The controller 138 may activate the gas generator 222 or one of the chambers of the gas generator 222 to produce gas pressure. In response to a control signal, extension-retraction mechanism actuates to extend or retract the mandrel by transferring fluid, e.g., oxygen, from a gas generator 222 to a chamber by the manifold 210. The controller 138 may stroke, e.g., linearly move, the adjustment tool 220 a portion of the adjustment length R in response to the signal. For example, the controller 138 may stroke the adjustment tool 220, to a position labeled R' in FIG. 4B, to locate the perforating gun assembly 38 to the target position. The controller 138 can extend the adjustment tool 220 by configuring one or more valves within the manifold 210 via the instructions from the signal received by the communication system 140. The manifold 210 can transfer fluid from chamber 108 to the annulus 48 via the bleed port as gas is transferred from the gas generator 222 to the chamber 102 via the line 208, the manifold 210, and the control line 214. The controller 138 can retract the adjustment tool 220 by configuring one or more valves within the manifold 210 to bleed fluid, e.g., oxygen, from the chamber 102 as oxygen pressure from the gas generator 222 is transferred to the chamber 108. It is understood that the controller 138 may signal the gas generator 222 to produce gas pressure on a as needed basis. The manifold 210 may set one or more valves to transfer the fluid, e.g., oxygen, from chamber 102 to the annulus 48 via the control line 214, the manifold 210 and the bleed port. The manifold 210 may set one or more valves to transfer the fluid, e.g., nitrogen or hydraulic fluid, from gas generator 222 to chamber 108. The controller 138 may obtain data from one or more pressure sensors fluidly connected to the gas generator 222, the chamber 108, and the chamber 102. The pressure sensors may be directly connected or fluidly connected via the manifold 210, control line 212, control line 214, and line 208. The position of the mandrel 168 can be determined by the pressure sensors measuring the pressure of fluid within the chamber 108 and the chamber 102, by a linear transducer measuring a linear distance, or a combination thereof. The linear transducer can be located inside the chamber 102, on the outer surface 188 of the lower mandrel 168, between the upper mandrel 166 and the service packer 170, or inside the chamber 108. The controller 138 can send a confirmation signal to surface via the communication system 140. After the perforating guns 38 are located within the target zone, the procedure can move to the next step.

The service personnel at surface may set the service packer 32 with work string 28 manipulation. The upward motion of the work string 28 can move the lug from a first position to a second j-track position so that the service packer 32 sets with downward movement of the work string 28. After the service packer has been set, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Figure 5:
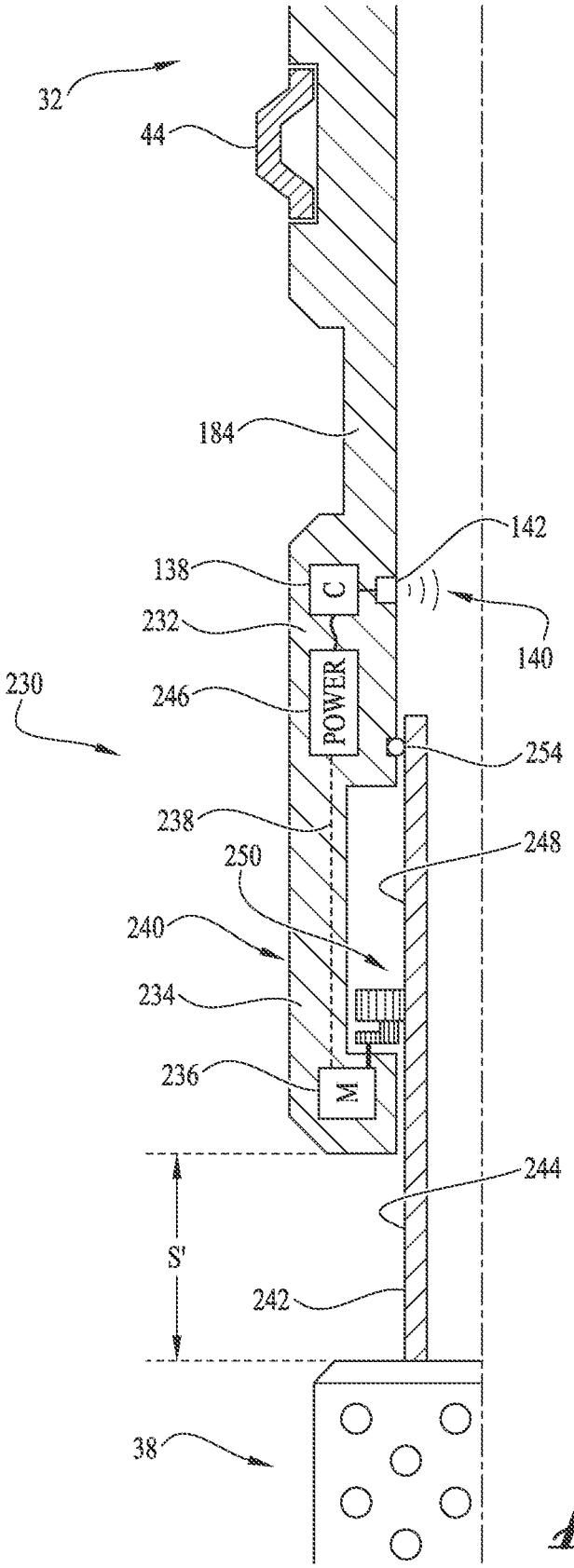
FIG. 5 is a partial sectional view of an adjustment tool with a gearing system according to an embodiment of the present invention.

In a sixth configuration, the adjustment tool 34 can be configured to axially and rotationally align a perforating gun assembly within a target zone with a gear system that extends the lower mandrel from an initial position to a target position. The toolstring 26 from FIG. 1, can be configured with an adjustment tool with a gear system. Turning now to FIG. 5, an embodiment of the adjustment tool 34 includes an extend-retract mechanism with gear system is described. In this embodiment, adjustment tool 230 includes features in common with adjustment tool 100 shown in FIG. 2, and thus, shared features are labeled similarly. The adjustment tool 230 can comprise a control sub 232, a gear system 240, and a threaded lower mandrel 242. The control sub 232 comprises a controller 138, a communication system 140, a power supply 246, a transmission cable 238, and a housing 234. The housing can include a motor 236 and the gear system 240 wherein the motor 236 is mechanically connected to the gear system 240. The gear system 240, mounted within the housing 234, can include a ring gear and a plurality of planet gears configured to mechanically engage and extend the lower mandrel 242. The transmission cable 238 can communicatively connect the power supply 246 and the controller 138 to the motor 236. The lower mandrel 242 can couple to the perforating gun assembly 38. The lower mandrel 242 can have a threaded portion 244 and a sealing portion 248 of the outer surface 250. The seal assembly 254 located in the control sub 232 can sealingly engage the sealing portion 248 of the lower mandrel 242. The gear system 240 mounted inside the housing 234 can mechanically engage, or couple to, the threaded portion 244 of the lower mandrel 242. The perforating gun assembly 38 can be retained in a run-in position by configuring the gear system 240, that is mechanically coupled to the lower mandrel 242, to remain in a stationary position. The control sub 232 can be couple to the service packer 32 by a connector sub 184. The adjustment tool 230 can extend the lower mandrel 242 a distance labeled S, the adjustment length, which is the distance from the housing 234 to the perforating gun assembly 38. The controller 138 can activate the motor 236 to turn the gear system 240 to extend or retract the lower mandrel 242 and perforating gun assembly 38.

The operational sequence of locating the perforating gun assembly within the target zone with the service packer 32, adjustment tool 230, and perforating gun assembly 38 of FIG. 5, is described. In an embodiment, the service packer 32 comprises a packer actuation assembly that can restrict or allow the service packer 32 to set, or actuate, and anchor and seal against the casing. The toolstring 26 can be conveyed on the work string 28 to a predetermined depth based on a target zone of the formation to be perforated by the perforating gun assembly 38. As previously described, the tag locating tool can determine the location of toolstring 26 relative to the target zone. If the toolstring 26 is located within the target depth, e.g., the perforating gun assembly 38 is located within, or can be repositioned to, the production zone 18, the procedure can continue to the next step The adjustment tool 230 can be stroked from a run-in position, e.g., a non-stroked position, during run-in of the toolstring 26, to a second position that places the perforating gun assembly into the target zone. An acoustic signal can be transmitted from surface to the communication system 140 that is configured to listen, i.e., receive signals. The controller 138 may stroke, e.g., linearly move, the adjustment tool 230 a portion of the adjustment length S in response to the signal. In response to a control signal, extension-retraction mechanism actuates to extend or retract the mandrel by activating the motor 236 to rotate the gear system 240 to move along a threaded portion of the lower mandrel 242. For example, the controller 138 may stroke the adjustment tool 230, to a second position to locate the perforating gun assembly 38 to the target position. The controller 138 can extend the adjustment tool 230 by send a signal, e.g., voltage and power, to the motor 236 to turn the gear system 240 to move linearly along the threaded portion 244 of the lower mandrel 242. The controller 138 may obtain data from the motor 236, e.g., number of rotations and angular position of the motor shaft. The position of the mandrel 242 can be determined by the data from the motor 236, by a linear transducer measuring a linear distance, or a combination thereof. The linear transducer can be located inside the housing 234, on the outer surface of the lower mandrel 242, between the housing 234 and the perforating gun assembly 38, or combination thereof. The perforating gun assembly 38 can be radially aligned, e.g., oriented to a compass direction, i.e., 90 degrees. The angular position of the lower mandrel 242 and the perforating gun assembly 38 can be determined from the data from the motor 236, e.g., angular position of the motor shaft. The controller 138 can send a confirmation signal via the communication system 140. After the perforating guns 38 are located within the target zone, the procedure can move to the next step.

The service personnel at surface may set the service packer 32 with work string 28 manipulation. The upward motion of the work string 28 can move the lug from a first position to a second j-track position so that the service packer 32 sets with downward movement of the work string 28. After the service packer has been set, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Figure 6:
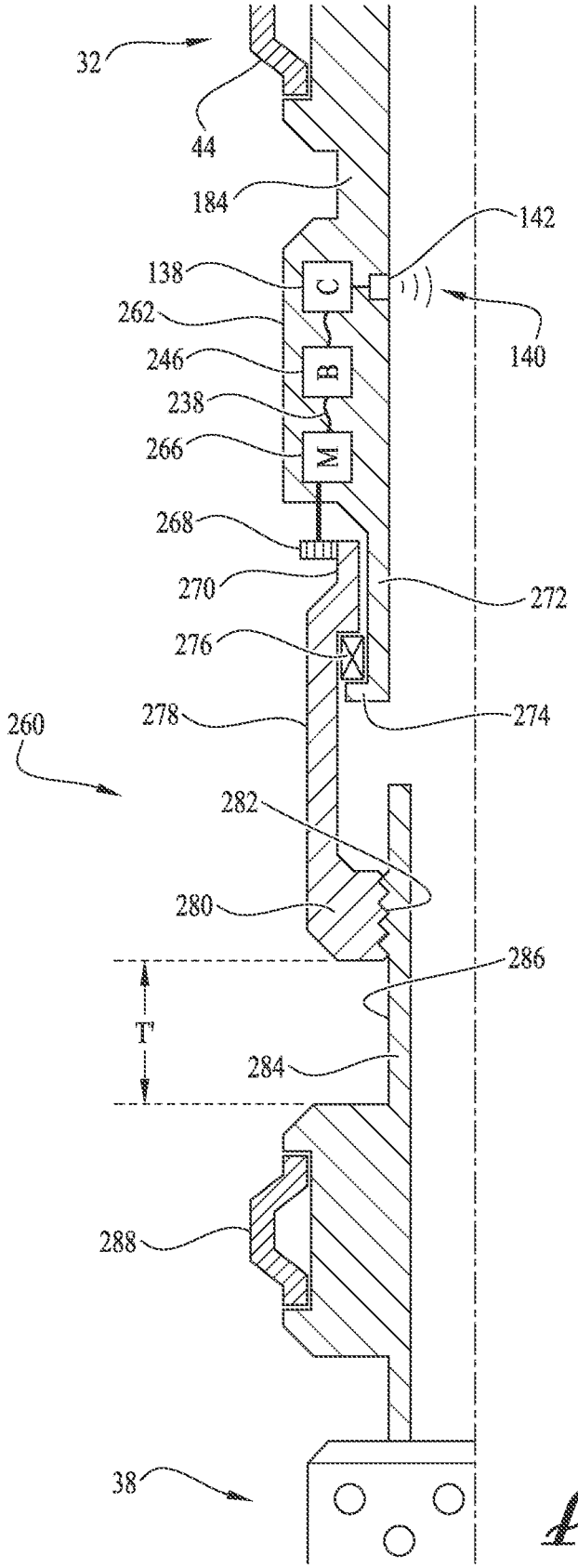
FIG. 6 is a partial sectional view of an adjustment tool with a threaded extension according to an embodiment of the present invention.

In a seventh configuration, the adjustment tool can move the perforating gun assembly from a first position to a second position with a threaded extension. The toolstring 26 from FIG. 1, can be configured with an adjustment tool with second set of drag blocks below a threaded extension. Turning now to FIG. 6, the adjustment tool with an extend-retract mechanism comprising a motor turning a threaded extension along a threaded mandrel is described. In this embodiment, adjustment tool 260 includes features in common with adjustment tool 100 shown in FIG. 2, and thus, shared features are labeled similarly. The adjustment tool 260 can comprise a control sub 262, an extension housing 278, a threaded lower mandrel 284, and a second drag block assembly 288. The control sub 262 comprises a controller 138, a communication system 140, a power supply 246, a motor 266, and a gear system 268. An extension sub 272 is coupled between the control sub 262 and a bearing sub 274. The bearing 276 can be a linear bearing, a roller bearing, or combination thereof. The bearing 276 can be housed between the bearing sub 274 and extension housing 278. The extension housing 278 includes a threaded upper surface 270, and an end sub 280. The threaded upper surface 270 can be mechanically coupled to the gear system 268. The end sub 280 includes an inner threaded surface 282 engaged with the threaded outer surface 286 of the lower mandrel 284. The lower mandrel 284 can be coupled to the second drag block assembly 288. The perforating gun assembly 38 can be coupled to the second drag block assembly 288. The motor 236 is mechanically connected to the gear system 240. A transmission cable 238 can communicatively connect the power supply 246 and the controller 138 to the motor 266. The perforating gun assembly 38 can be retained in a run-in position by configuring the gear system 240, that is mechanically coupled to the threaded upper surface 270 of the extension housing 278, to remain in a stationary position. The control sub 262 can be couple to the service packer 32 by a connector sub 184. The adjustment tool 260 can extend the lower mandrel 284 a distance labeled T, the adjustment length, which is the distance from the end sub 280 to the drag block assembly 288. The controller 138 can activate the motor 266 to turn the gear system 268 to rotate the extension housing 278. The lower drag block assembly 288 prevents the extension housing 278 from rotating the lower mandrel 284 and therefore allows the extension housing 278 to threadingly extend or retract the lower mandrel 284 and perforating gun assembly 38.

The operational sequence of locating the perforating gun assembly with the target zone with an adjustment sub in the toolstring 26 in FIG. 1 with the service packer 32, adjustment tool 260, and perforating gun assembly 38 of FIG. 6, is described. In an embodiment, the service packer 32 comprises a packer actuation assembly that can restrict or allow the service packer 32 to set, or actuate, and anchor and seal against the casing. The toolstring 26 can be conveyed on the work string 28 to a predetermined depth based on a target formation to be perforated by the perforating gun assembly 38. As previously described, the tag locating tool can determine the location of toolstring 26 relative to the target zone. If the toolstring 26 is located within the target depth, the procedure can move to the next step.

The adjustment tool 260 can be configured in a run-in position, e.g., a non-stroked position, during run-in of the toolstring 26. An acoustic signal can be transmitted from surface to the communication system 140 that is configured to listen, i.e., receive signals. The controller 138 may stroke, e.g., linearly move, the adjustment tool 260 a portion of the adjustment length T in response to the signal. In response to a control signal, extension-retraction mechanism actuates to extend or retract the mandrel by activating the motor 266 to rotate the gear system 268 to rotate the extension housing 278 to move along a threaded portion of the lower mandrel 284. For example, the controller 138 may stroke the adjustment tool 260, to a second position to locate the perforating gun assembly 38 to the target position. The controller 138 can extend the adjustment tool 260 by send a signal, e.g., voltage and power, to the motor 266 to turn the gear system 268 to rotate the extension housing 278 to move linearly along the threaded outer surface 286 of the lower mandrel 284. The controller 138 may obtain data from the motor 266, e.g., number of rotations and angular position of the motor shaft. The position of the mandrel 284 can be determined by the data from the motor 266, by a linear transducer measuring a linear distance, or a combination thereof. The linear transducer can be located inside the extension housing 278, on the outer surface 286 of the lower mandrel 284, between the end sub 280 and the drag block assembly 288, or combination thereof. The controller 138 can send a confirmation signal via the communication system 140. After the perforating guns 38 are located within the target zone, the procedure can move to the next step.

The service personnel at surface may set the service packer 32 with work string 28 manipulation. The upward motion of the work string 28 can move the lug from a first position to a second j-track position so that the service packer 32 sets with downward movement of the work string 28. After the service packer has been set, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

Figure 7:
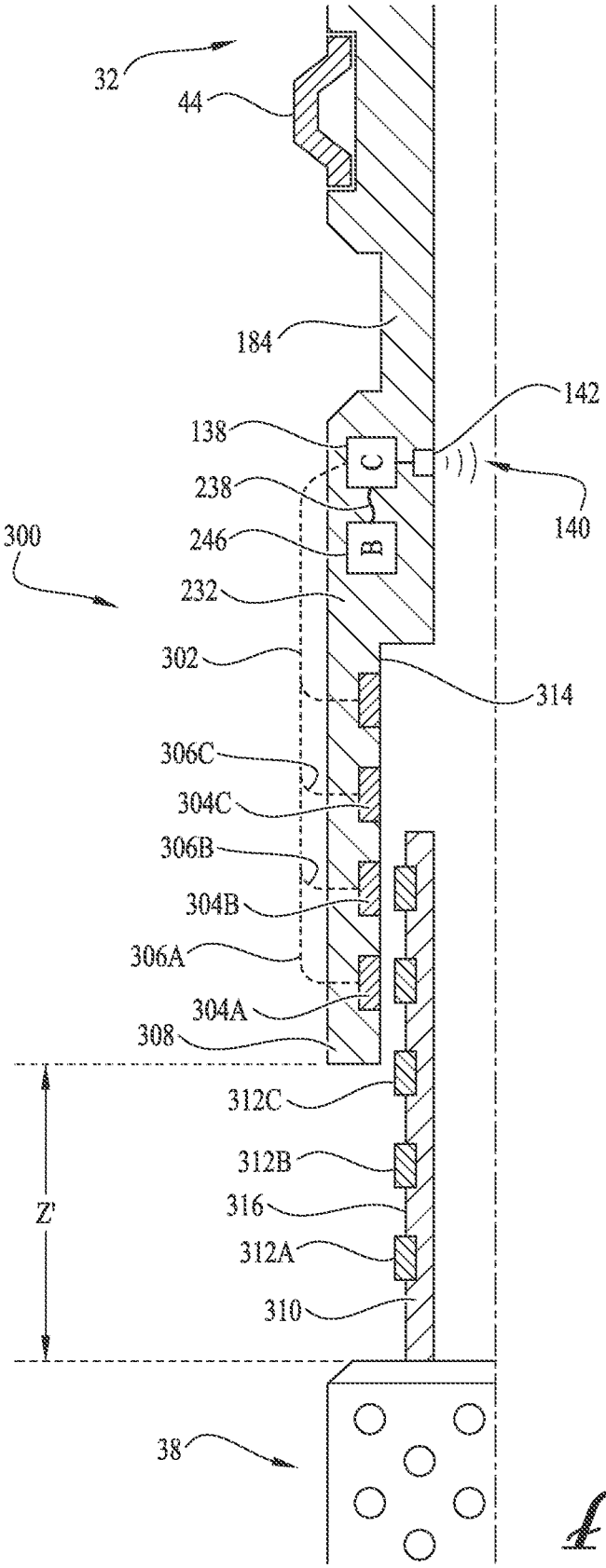
FIG. 7 is a partial sectional view of an adjustment tool with an electromagnet system according to an embodiment of the present invention.

In an eighth configuration, the adjustment tool can move the perforating gun assembly from a first position to a second position with an electromagnetic extension system. The toolstring 26 from FIG. 1, can be configured with an adjustment tool with an extend-retract mechanism utilizing an electromagnetic extension system. Turning now to FIG. 7, the adjustment tool with an electromagnetic extension system is described. In this embodiment, adjustment tool 300 includes features in common with adjustment tool 100 shown in FIG. 2, and thus, shared features are labeled similarly. The adjustment tool 300 can comprise a control sub 232, a housing 308, and a plurality of electromagnets 304A-C. The control sub 232 comprises a controller 138, a communication system 140, a power supply 246, and a transmission cable 238. The housing 308 includes a plurality of electromagnets 304 mounted within or attached to the inner surface 314. The transmission cable 238 can communicatively connect the power supply 246 to the controller 138. The plurality of electromagnets 306 can communicatively connect to the controller via signal cables 306A-C and sensor cable 302. For example, the electromagnet 304A can communicatively connect to the controller 138 via signal cable 306A. The electromagnets may be formed of electromagnet coils wound about a ring, a core, or a coil insulator. The lower mandrel 310 can include a plurality of permanent magnets 312A-C mounted to the outer surface 316 or installed within. The permanent magnets may be made of neodymium-iron-boron, samarium-cobalt, Alnico, strontium ferrite, or other permanent magnet materials. The lower mandrel 310 can couple to the perforating gun assembly 38. The plurality of electromagnets 304A-C can magnetically engage the permanent magnets 312A-C mounted on the lower mandrel 310. Although four electromagnets 304 and five permanent magnets 312 are illustrated, it is understood that 4, 8, 16, 32, or any number of permanent magnets 312 and electromagnets 304 may be used. Although the permanent magnets 312 and electromagnets 306 are illustrated as aligned, it is understood that the size and spacing of the permanent magnets 312 and electromagnets 306 may vary. For example, three permanent magnets 312 may span the same distance as two electromagnets 304 based on the size and placement of the electromagnets 304, or vice versa. The controller 138 can send a signal, e.g., voltage and power, to the plurality of electromagnets 304A-C to engage the plurality of permanent magnets 312A-C to retain the perforating gun assembly 38 in the run-in position. The weight of the perforating gun assembly 38 transfers from the lower mandrel 310 via the shared magnetic engagement of the permanent magnets 312A-C to the electromagnets 304A-C within the housing 308. The control sub 232 can couple to the service packer 32 by a connector sub 184. The adjustment tool 300 can extend the lower mandrel 310 a distance labeled Z, the adjustment length, which is the distance from the housing 308 to the perforating gun assembly 38. The controller 138 can activate and deactivate the electromagnets 304A-C in a predetermined manner, e.g., programmed procedure, to extend or retract the lower mandrel 310 and perforating gun assembly 38.

The operational sequence of the toolstring 26 in FIG. 1 with the service packer 32, adjustment tool 300, and perforating gun assembly 38 of FIG. 5, is described. In an embodiment, the service packer 32 comprises a packer actuation assembly that can restrict or allow the service packer 32 to set, or actuate, and anchor and seal against the casing. The toolstring 26 can be conveyed on the work string 28 to a predetermined depth based on a target formation to be perforated by the perforating gun assembly 38. As previously described, the tag locating tool can determine the location of toolstring 26 relative to the target zone. If the toolstring 26 is located within the target depth, the procedure can move to the next step.

The adjustment tool 300 can be actuated to place the perforating gun assembly 38 within the target zone. The adjustment tool 300 can be configured in a run-in position, e.g., a non-stroked position, during run-in of the toolstring 26. An acoustic signal can be transmitted from surface to the communication system 140 that is configured to listen, i.e., receive signals. The controller 138 may stroke, e.g., linearly move, the adjustment tool 300 a portion of the adjustment length Z in response to the signal. In response to a control signal, extension-retraction mechanism actuates to extend or retract the mandrel by actuating a plurality of electromagnets 304A-C to linearly move the lower mandrel 310. For example, the controller 138 may stroke the adjustment tool 300, to a second position to locate the perforating gun assembly 38 to the target position. The controller 138 can extend the adjustment tool 300 by sending a signal, e.g., voltage and power, the plurality of electromagnets 304A-C to selectively engage and disengage the plurality of permanent magnets 312A-C to linearly move, e.g., extend, the lower mandrel 310. The controller 138 may obtain data from the linear transducer and from the plurality of electromagnets 304. The linear transducer can be located inside the housing 308, on the outer surface 316 of the lower mandrel 310, between the housing 308 and the perforating gun assembly 38, or combination thereof. The controller 138 can send a confirmation signal via the communication system 140. After the perforating guns 38 are located within the target zone, the procedure can move to the next step.

The service personnel at surface may set the service packer 32 with work string 28 manipulation. The upward motion of the work string 28 can move the lug from a first position to a second j-track position so that the service packer 32 sets with downward movement of the work string 28. After the service packer has been set, the procedure can move to the next step.

The service personnel may signal the perforating gun assembly from surface to fire one or more gun sections to perforate the casing, for example perforations 24 in casing 20 as shown in FIG. 1. The service personnel can manipulate the work string 28 to unset the service packer 32 and proceed to the next zone to be perforated or return to surface.

In a ninth configuration, the adjustment tool 34 can be configured to automatically position the perforating gun assembly 38 into the target zone. Returning to FIG. 1, the toolstring 26 can comprise a work string 28, a tag locating assembly 30, a service packer 32, an adjustment tool 34, and a perforating gun assembly 38. The adjustment tool 34 can be configured to retain the service packer in the run-in position, unlock the service packer for actuation, reposition the perforating gun assembly 38 into a target zone, and set the service packer. The adjustment tool 34 can be configured with a mandrel that is held in the fully retracted position by an extend-retract mechanism that comprises any of the methods described in FIG. 2 through FIG. 7, for example the hydraulic system (from FIG. 2) with a trapped volume of fluid and a pump. The service packer 32 can be retained in a run-in position by a feature deactivated by the adjustment tool 34.

In an embodiment, the tag locating assembly 30 can comprise one or more sensors, a printed circuit board, a transceiver, a microprocessor, non-transitory memory, and an application executing in memory. The application executing in non-transitory memory can include instructions stored therein, e.g., the application, defining the operation of the tag locating assembly 30. The tag locating assembly 30 can include a power source such as one or more batteries or ultracapacitors. The sensor can be a nuclear sensor that measures gamma ray or neutron count rates. The tag locating assembly 30 can be communicatively coupled to the controller 138 of the adjustment tool 100.

In this embodiment, adjustment tool includes features in common with adjustment tool 100 shown in FIG. 2, and thus, shared features are labeled similarly. As previously described, the adjustment tool 100 can include an anchoring mechanism 36 to retain the perforating gun assembly 38 within a short production zone. The adjustment tool 100 includes an extend-retract mechanism with a hydraulic system comprising a trapped volume of fluid and a pump 104. The anchoring mechanism 110 can be coupled to the control sub 134 of the adjustment tool 100. The anchoring mechanism 110 can comprise a plurality of deployable anchors 146.

The service packer, e.g., 32 in FIG. 1, can include a feature that is unlocked by the adjustment tool 100. In an embodiment, the service packer 120 comprises a packer actuation assembly 156 that includes a lug lock 158 that restricts the lug to a first position within the j-slot and thereby restricts the service packer 120 to the run-in position. The piston 116 of the adjustment tool 100 can abut the lug lock 158 and retain the lug lock 158 in a first position that restricts the lug to a first position while the adjustment tool 100 is in the run-in position. The movement of the piston 116, e.g., extending the mandrel 114 of the adjustment tool 100 from an initial position, can release the lug lock 158 to move to a second position and thereby release the lug from the first position of within the j-slot.

The operational sequence of locating the perforating gun assembly within the target zone with a tag locating assembly 30, the service packer 120, adjustment tool 100 with the anchoring mechanism 110, and perforating gun assembly 38 of FIG. 1 and FIG. 2, is described. The toolstring 26 can be conveyed on the work string 28 to an estimated target depth, e.g., the predetermined depth based on a target zone of the formation to be perforated by the perforating gun assembly 38. They conveyance of the toolstring 26 can be slowly moved through the estimated target depth. The tag locating assembly 30 can actively survey the casing 20 for one or more casing tags 22. The toolstring 26 can be repositioned, e.g., moved up or down, by the work string 28, to slowly move the toolstring 26 at the target depth such that the tag locating assembly 30 can survey and locate the casing tag 22. The tag locating assembly 30 can transmit a command signal to the controller 138 within the adjustment tool 100 when the tag locating assembly 30 locates the one or more casing tag 22 and determines the perforating gun assembly 38 is within the target zone.

The controller 138 may actuate the anchoring mechanism 36 to retain the perforating gun assembly 38 within the target zone. The controller 138 may signal the deployment cylinder 152 to extend the deployable anchors 146. The controller 138 may provide power and voltage to an electromagnet to extend the deployable anchors 146 to grip the inner surface 50 of the casing 20 as illustrated in FIG. 1. Alternately, the controller 138 may signal the pump 104 to supply fluid to the deployment cylinder 152 with volume and pressure to extend the deployable anchors 146 and grip the inner surface 50 of the casing 20. After the deployable anchors 146 anchor the perforating gun assembly 38 to the target depth, the controller may automatically continue to the next step.

The adjustment tool 100 can extend to move the bottom of the service packer 120 upwards to set the slips 42 into the casing 20. The controller 138 may continue a preprogrammed method. The controller 138 may activate the pump 104 to transfer fluid from the chamber 102 to chamber 108 via the fluid path 106A and 106B. The transfer of fluid may subsequently move the packer actuation assembly 156 and drag block assembly 44 of the service packer 120 uphole, e.g., towards the surface, to extend the slips 42 to the inner surface 50 of the casing 20. The movement of the piston 116 may release the lug lock 158 and unlock the actuation assembly 156 of the service packer 120 of FIG. 2 or 32 of FIG. 1. The signal generator 142 can send a confirmation signal after the successful completion of this step. The service personnel at surface can move the work string 28 downhole, e.g., towards the bottom of the wellbore, to apply weight to the service packer 120 to anchor the slips 42 and compress the sealing elements to seal against the inner surface 50 of the casing 20. The controller may automatically continue to the next step.

The tag locating assembly 30 may recheck the location of the casing tag 22. The controller 138 of the adjustment tool 100 can transmit a command to the tag locating assembly 30. The tag locating assembly 30 may survey the casing 22 to locate the casing tag 22. The tag locating assembly 30 may determine the location of the perforating gun assembly 38 based on the location of the casing tag 22. The tag locating assembly 30 can transmit a command to the adjustment tool 100 to either move the perforating gun assembly 38, e.g., extend or retract the mandrel, if the perforating gun assembly 38 is no longer in the target zone. The tag locating assembly 30 can signal the controller 138 to continue to the next step. The controller 138 may send a command to the communication system 140 to send a confirmation signal to the service personnel at surface.

In an embodiment, a downhole tool position adjustment assembly, comprising a mandrel 114 coupled to a housing 112 by an extend-retract mechanism, wherein actuation of the extend-retract mechanism moves the mandrel 114 relative to the housing 112, a controller 138 communicatively connected to the extend-retract mechanism, and a tag locating assembly, communicatively connected to the controller 138 and configured to identify one or more tags coupled to the casing, wherein the controller 138 is configured to send a control signal to actuate the extend-retract mechanism in response to a command signal transmitted by the tag locating assembly.

Figure 8:
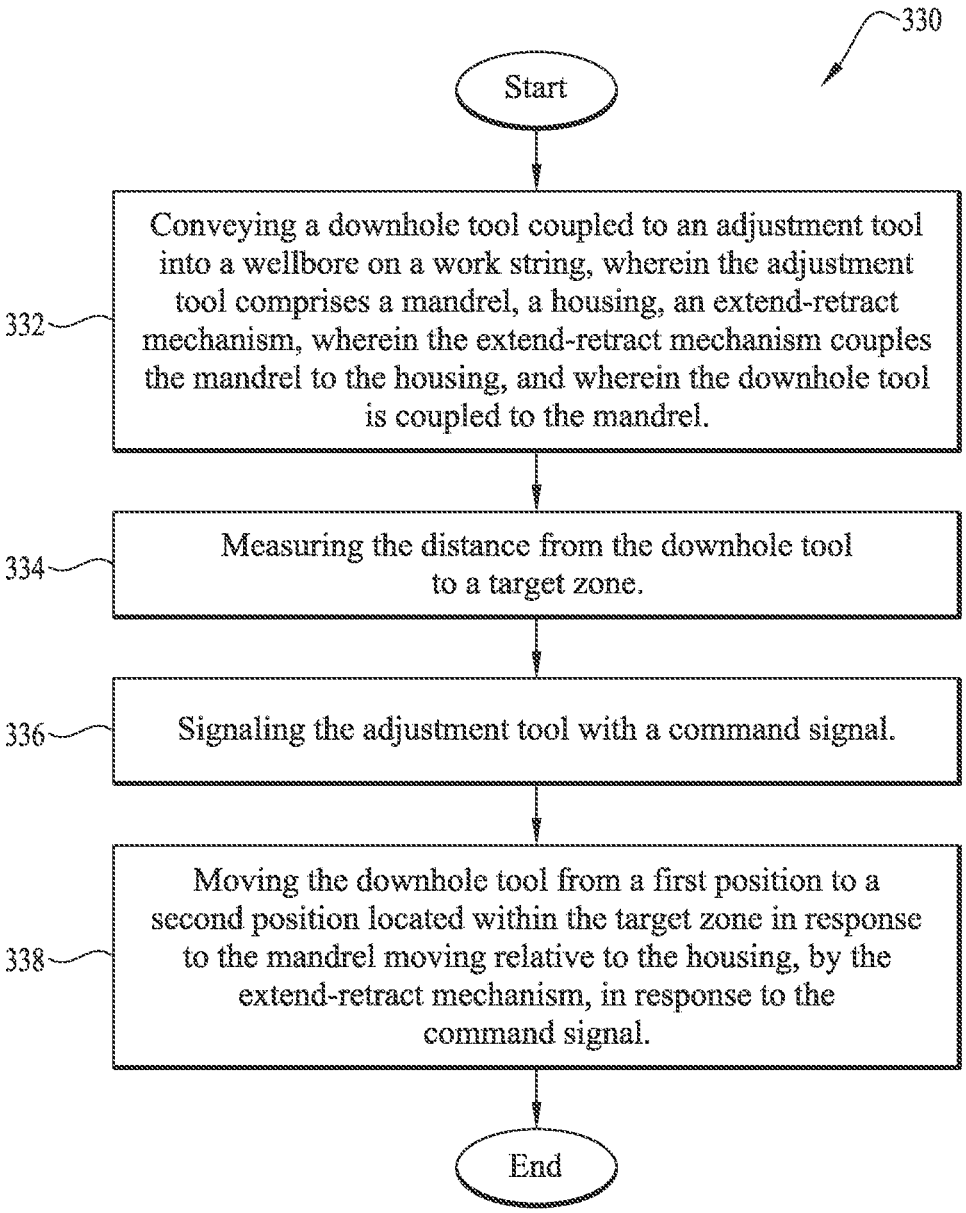
FIG. 8 is a flow chart of a method according to an embodiment of the present invention.

Turning now to FIG. 8, a method 330 is described. In an embodiment, the method 330 is a method of positioning a downhole tool assembly. At block 332, the method 330 comprises conveying a downhole tool coupled to an adjustment tool into a wellbore on a work string, wherein the adjustment tool comprises a mandrel, a housing, an extend-retract mechanism, wherein the extend-retract mechanism couples the mandrel to the housing, and wherein the downhole tool is coupled to the mandrel.

At block 334, the method 330 comprises measuring the distance from the downhole tool to a target zone. At block 336, the method 330 comprises signaling the adjustment tool with a command signal. At block 338, the method 330 comprises moving the downhole tool from a first position to a second position located within the target zone in response to the mandrel moving relative to the housing, by the extend-retract mechanism, in response to the command signal.

Figure 9:
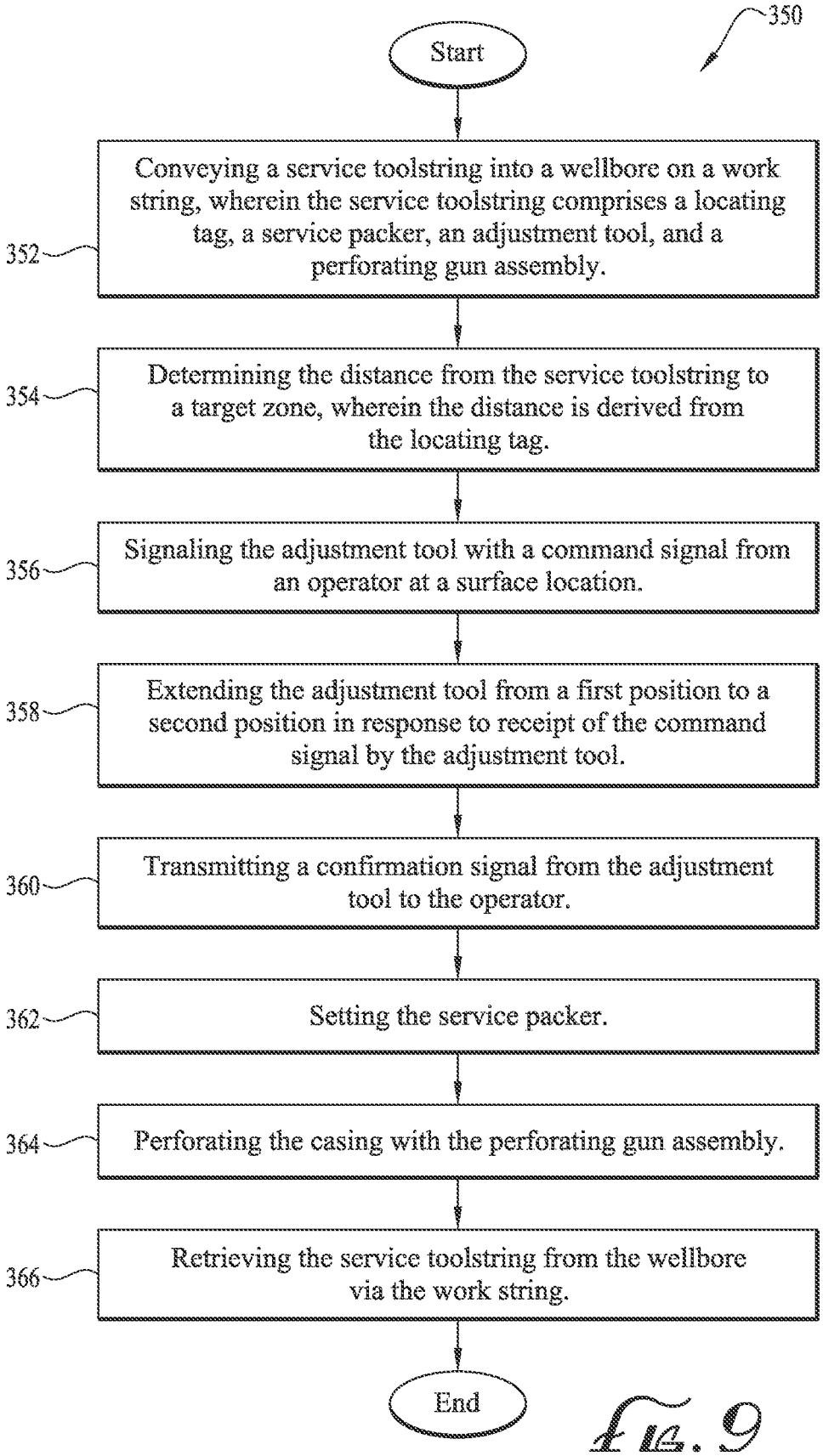
FIG. 9 is a flow chart of a method according to another embodiment of the present invention.

Turning now to FIG. 9, a method 350 is described. In an embodiment, the method 350 is a method of positioning a perforating gun assembly. At block 352, the method 350 comprises conveying a service toolstring into a wellbore on a work string, wherein the service toolstring comprises a locating tag, a service packer, an adjustment tool, and a perforating gun assembly. At block 354, the method 350 comprises determining the distance from the service toolstring to a target zone, wherein the distance is derived from the locating tag.

At block 356, the method 350 comprises signaling the adjustment tool with a command signal from an operator at a surface location. At block 358, the method 350 comprises extending the adjustment tool from a first position to a second position in response to receipt of the command signal by the adjustment tool. At block 360, the method 350 comprises transmitting a confirmation signal from the adjustment tool to the operator.

At block 362, the method 350 comprises setting the service packer. At block 364, the method 350 comprises perforating the casing with the perforating gun assembly. At block 366, the method 350 comprises retrieving the service toolstring from the wellbore via the work string.

ADDITIONAL DISCLOSURE

The following are non-limiting, specific embodiments in accordance with the present disclosure:

A first embodiment, which is a downhole tool activation assembly, comprising a mandrel 114 coupled to a housing 112 by an extend-retract mechanism, wherein actuation of the extend-retract mechanism moves the mandrel 114 relative to the housing 112, a controller 138 communicatively connected to the extend-retract mechanism, and a communication system 140, communicatively connected to the controller 138 and configured to receive a command signal transmitted by an operator at a surface location, wherein the controller is configured to send a control signal to actuate the extend-retract mechanism in response to the command signal received by the communication system 140.

A second embodiment, which is the downhole tool position adjustment assembly of the first embodiment, wherein the extend-retract mechanism includes, a first chamber 102 formed between the mandrel 114, the housing 112, and a piston 164, wherein the first chamber 102 is fluidly connected to a pump 104, a second chamber 108 is fluidly connected to the pump 104, wherein the pump 104 transfers fluid from the first chamber 102 to the second chamber 108 in response to the control signal, and wherein the mandrel 114 moves relative to the housing 112 in response to a decrease in volume of the first chamber 102 in response to the transfer of fluid from the first chamber 102.

A third embodiment, which is the downhole tool position adjustment assembly of the first and second embodiment, wherein the pump 104 transfers fluid from the second chamber 108 to the first chamber 102 in response to the control signal, and wherein the mandrel 114 moves relative to the housing 112 in response to an increase in volume of the first chamber 102 in response to the transfer of fluid to the first chamber 102.

A fourth embodiment, which is the downhole tool position adjustment assembly of any of the first through third embodiments, wherein the extend-retract mechanism includes, a first chamber 102 formed between an upper mandrel 166, the housing 162, and a piston 164, a second chamber 108 formed between a lower mandrel 168, the housing 162, and the piston 164, wherein the lower mandrel 168 is coupled to the mandrel 114, wherein the first chamber 102 is fluidly connected to a manifold 210, wherein the second chamber 108 is fluidly connected to the manifold 210, a gas source 206, 222 fluidly connected to the manifold 210, wherein the manifold 210 transfers fluid from the gas source 206 to the first chamber 102 and transfers fluid from the second chamber 108 to a bleed port in response to the control signal, and wherein the lower mandrel 168 moves relative to the housing 162 in response to an increase in volume of the first chamber 102 in response to the transfer of fluid from the gas source 206.

A fifth embodiment, which is the downhole tool position adjustment assembly of any of the first through the fourth embodiments, wherein the manifold 210 transfers fluid from the gas source 206 to the second chamber 108 and transfers fluid from the first chamber 102 to a bleed port in response to the control signal, and wherein the lower mandrel 168 moves relative to the housing 162 in response to an increase in volume of the second chamber 108 in response to the transfer of fluid from the gas source.

A sixth embodiment, which is the downhole tool position adjustment assembly of any of the first through the fifth embodiments, wherein the gas source 206 comprises a nitrogen source 206 or a gas generator 222.

A seventh embodiment, which is the downhole tool position adjustment assembly of any of the first through the sixth embodiments, wherein the extend-retract mechanism includes a motor 236 and a gear system 240 installed within the housing 234, a threaded surface 244 of a lower mandrel 242 mechanically coupled to the gear system 240, wherein the lower mandrel 242 is coupled to the mandrel 114, wherein the gear system 240 is rotationally connected to a motor 236, wherein the gear system 240 travels along the threaded surface 244 of the lower mandrel 242 in response to the rotation of the gear system 240 by the motor 236 in response to the control signal, and wherein the lower mandrel 242 moves relative to the housing 234 in response to the gear system 240 traveling along the threaded surface 244.

An eighth embodiment, which is the downhole tool position adjustment assembly of any of the first through the seventh embodiments, wherein the extend-retract mechanism includes, an inner threaded surface 282 of an end sub 280 coupled to a housing 278 threadingly coupled to a threaded outer surface 286 of a lower mandrel 284, wherein the lower mandrel 284 is coupled to the mandrel 114, a gear system 268 mechanically coupled to a threaded surface 270 of the housing 278, a motor 266 rotationally coupled to the gear system 268, wherein the inner threaded surface 282, coupled to the housing 278, travels along the threaded outer surface 286 of the lower mandrel 284 in response to the rotation of the gear system 268 by the motor 266 in response to the control signal, and wherein the lower mandrel 284 moves relative to the housing 278 in response to the inner threaded surface 282 traveling along the threaded outer surface 286 of the lower mandrel 284.

A ninth embodiment, which is the downhole tool position adjustment assembly of any of the first through the eighth embodiments, wherein the extend-retract mechanism includes, a plurality of electromagnets 304 installed within the housing 308, wherein the electromagnets 304 are communicatively connected to the controller 138, a plurality of permanent magnets 312 installed on the outer surface 316 of the lower mandrel 310, wherein the lower mandrel 310 is coupled to the mandrel 114, wherein the lower mandrel 310 moves relative to the housing 308 in response to the plurality of permanent magnets 312 moving relative to the plurality of electromagnets, wherein the plurality of permanent magnets 312 move relative to the plurality of electromagnets 304 in response to the control signal.

A tenth embodiment, which is the downhole tool position adjustment assembly of any of the first through the ninth embodiments, further comprising a perforating gun assembly coupled to the mandrel, and wherein the perforating gun assembly is moved to a target zone in response to the movement of the mandrel relative to the housing.

An eleventh embodiment, which is the downhole tool position adjustment assembly of any of the first through the tenth embodiments, further comprising further comprising a service packer 32 comprising a sealing element, a set of slips 42, a drag block assembly 44, and a packer actuation assembly comprising a lug and a j-track, wherein a first position of the lug in the j-track retains the service packer 32 in the run-in position and a second position of the lug in the j-track allows the service packer 32 to actuate, and wherein the service packer 32 is coupled to the housing 112, wherein the mandrel 114 is coupled to the housing 112 by an extend-retract mechanism.

A twelfth embodiment, which is the downhole tool position adjustment assembly of any of the first through the eleventh embodiments, wherein the packer actuation assembly includes a lug lock 158, wherein the adjustment assembly abuts the lug lock 158 in the run-in position, wherein the lug lock 158 retains the lug in the first position of the j-track, and wherein the lug lock 158 releases the lug from the first position of the j-track in response to the extend-retract mechanism moving the mandrel relative to the housing.

A thirteenth embodiment, which is the method of any of the first through the twelfth embodiment, further comprising an anchoring mechanism 110 comprising a plurality of deployable anchors 146 housed within a plurality of deployment cylinders 152 coupled to the adjustment assembly, wherein the plurality of deployable anchors 146 are extended from the deployment cylinders 152 in response to an extend signal from the controller 138, wherein the extend signal generates one of i) a magnetic field generated at the bottom of the deployment cylinder, or ii) fluid pressure supplied by the pump 104, and wherein the deployable anchors 146 anchor to the inner surface 50 of the casing 20 in response to the extend signal from the controller 138.

A fourteenth embodiment, which is a method of positioning a downhole tool assembly, comprising conveying a downhole tool coupled to an adjustment tool into a wellbore on a work string, wherein the adjustment tool comprises a mandrel, a housing, an extend-retract mechanism, wherein the extend-retract mechanism couples the mandrel to the housing, and wherein the downhole tool is coupled to the mandrel, measuring the distance from the downhole tool to a target zone, signaling the adjustment tool with a command signal, and moving the downhole tool from a first position to a second position located within the target zone in response to the mandrel moving relative to the housing, by the extend-retract mechanism, in response to the command signal.

A fifteenth embodiment, which is the method of the fourteenth embodiment, further comprising unlocking a packer actuation assembly 180 on a service packer 170, wherein the packer actuation assembly 180 comprises a lug lock 158 in a first position retaining a lug in a run-in position within a j-slot, and wherein the mandrel moving relative to the housing moves the lug lock 158 to a second position, and wherein the lug is released to a second position within the j-slot in response to the lug lock 158 moving to the second position.

A sixteenth embodiment, which is the method of the fourteenth or the fifteenth embodiment, further comprising signaling an anchoring mechanism with a command signal, wherein the anchoring mechanism is coupled to the adjustment tool, anchoring the adjustment tool to a location within the casing by extending a plurality of deployable anchors, from the anchoring mechanism, and wherein the deployable anchors are extended in response to the command signal.

A seventeenth embodiment, which is the method of any of the fourteenth through sixteenth embodiments, further comprising extending the mandrel relative to the housing by the extend-retract mechanism, and setting a set of slips coupled to a service packer in response to a bottom part of the service packer moving upwards in response to the mandrel moving relative to the housing.

An eighteenth embodiment, which is the method of any of the fourteenth through the seventeenth embodiments, wherein setting a service packer comprises one of i) moving a lug in a j-slot from a first position to a second position by raising and lowering the work string, or ii) moving a lug in a j-slot to a second position by lowering the work string.

A nineteenth embodiment, which is the method of any of the fourteenth through the eighteenth embodiments, wherein the extend-retract mechanism is one of i) a hydraulic system with a volume of fluid and a pump, ii) a single pressure source with a manifold, iii) a gas generator with a manifold, iv) a motor driving a gear system, v) a motor turning a threaded extension, or vi) an electromagnetic extend-retract mechanism.

A twentieth embodiment, which is the method of any of the fourteenth through the nineteenth embodiments, wherein the downhole tool comprises a perforating gun assembly, a shifting tool, a valve, a setting tool, a packer, a frac plug, or combination thereof.

A twenty-first embodiment, which is a method of position a perforating fun assembly, comprising conveying a service toolstring into a wellbore on a work string, wherein the service toolstring comprises a locating tag, a service packer, an adjustment tool, and a perforating gun assembly, determining the distance from the service toolstring to a target zone, wherein the distance is derived from the locating tag, signaling the adjustment tool with a command signal from an operator at a surface location, extending the adjustment tool from a first position to a second position in response to receipt of the command signal by the adjustment tool, transmitting a confirmation signal from the adjustment tool to the operator, setting the service packer, perforating the casing with the perforating gun assembly, and retrieving the service toolstring from the wellbore via the work string.

A twenty-second embodiment, which is the method of the twenty-first embodiment, wherein further comprising signaling the adjustment tool with a second command signal from an operator at a surface location, actuating an anchoring mechanism, wherein the anchoring mechanism is coupled to the adjustment tool, anchoring the adjustment tool to the inner surface of the casing with the anchoring mechanism, and extending the adjustment tool to anchor the service packer to the inner surface of the casing.

A twenty-third embodiment, which is a downhole position adjustment assembly, comprising a mandrel 114 coupled to a housing 112 by an extend-retract mechanism, wherein actuation of the extend-retract mechanism moves the mandrel 114 relative to the housing 112, a controller 138 communicatively connected to the extend-retract mechanism, and a tag locating assembly, communicatively connected to the controller 138 and configured to identify one or more tags coupled to the casing, wherein the controller 138 is configured to send a control signal to actuate the extend-retract mechanism in response to a command signal transmitted by the tag locating assembly.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A downhole tool position adjustment assembly, comprising:

a mandrel 114 coupled to a housing 112 by an extend-retract mechanism, wherein actuation of the extend-retract mechanism moves the mandrel 114 relative to the housing 112;

a perforating gun assembly coupled to the mandrel;

a controller 138 communicatively connected to the extend-retract mechanism; and a communication system 140, communicatively connected to the controller 138 and configured to receive a command signal transmitted by an operator at a surface location, wherein the controller is configured to send a control signal to actuate the extend-retract mechanism in response to the command signal received by the communication system 140 and wherein the perforating gun assembly is moved to a target zone in response to the movement of the mandrel relative to the housing.

2. The downhole position adjustment assembly of claim 1, wherein the extend-retract mechanism includes:

a first chamber 102 formed between the mandrel 114, the housing 112, and a piston 164;

wherein the first chamber 102 is fluidly connected to a pump 104;

a second chamber 108 is fluidly connected to the pump 104;

wherein the pump 104 transfers fluid from the first chamber 102 to the second chamber 108 in response to the control signal; and wherein the mandrel 114 moves relative to the housing 112 in response to a decrease in volume of the first chamber 102 in response to the transfer of fluid from the first chamber 102.

3. The downhole position adjustment assembly of claim 2, wherein the pump 104 transfers fluid from the second chamber 108 to the first chamber 102 in response to the control signal, and wherein the mandrel 114 moves relative to the housing 112 in response to an increase in volume of the first chamber 102 in response to the transfer of fluid to the first chamber 102.

4. The downhole position adjustment assembly of claim 1, wherein the extend-retract mechanism includes:

a first chamber 102 formed between an upper mandrel 166, the housing 162, and a piston 164;

a second chamber 108 formed between a lower mandrel 168, the housing 162, and the piston 164, wherein the lower mandrel 168 is coupled to the mandrel 114;

wherein the first chamber 102 is fluidly connected to a manifold 210;

wherein the second chamber 108 is fluidly connected to the manifold 210;

a gas source 206, 222 fluidly connected to the manifold 210;

wherein the manifold 210 transfers fluid from the gas source 206 to the first chamber 102 and transfers fluid from the second chamber 108 to a bleed port in response to the control signal; and wherein the lower mandrel 168 moves relative to the housing 162 in response to an increase in volume of the first chamber 102 in response to the transfer of fluid from the gas source 206.

5. The downhole position adjustment assembly of claim 4, wherein the manifold 210 transfers fluid from the gas source 206 to the second chamber 108 and transfers fluid from the first chamber 102 to a bleed port in response to the control signal, and wherein the lower mandrel 168 moves relative to the housing 162 in response to an increase in volume of the second chamber 108 in response to the transfer of fluid from the gas source.

6. The downhole position adjustment assembly of claim 4, wherein the gas source 206 comprises a nitrogen source 206 or a gas generator 222.

7. The downhole position adjustment assembly of claim 1, wherein the extend-retract mechanism includes:

a motor 236 and a gear system 240 installed within the housing 234;

a threaded surface 244 of a lower mandrel 242 mechanically coupled to the gear system 240, wherein the lower mandrel 242 is coupled to the mandrel 114;

wherein the gear system 240 is rotationally connected to a motor 236;

wherein the gear system 240 travels along the threaded surface 244 of the lower mandrel 242 in response to the rotation of the gear system 240 by the motor 236 in response to the control signal, and wherein the lower mandrel 242 moves relative to the housing 234 in response to the gear system 240 traveling along the threaded surface 244.

8. The downhole position adjustment assembly of claim 1, wherein the extend-retract mechanism includes:

an inner threaded surface 282 of an end sub 280 coupled to the housing 278 threadingly coupled to a threaded outer surface 286 of a lower mandrel 284, wherein the lower mandrel 284 is coupled to the mandrel 114;

a gear system 268 mechanically coupled to a threaded surface 270 of the housing 278;

a motor 266 rotationally coupled to the gear system 268;

wherein the inner threaded surface 282, coupled to the housing 278, travels along the threaded outer surface 286 of the lower mandrel 284 in response to the rotation of the gear system 268 by the motor 266 in response to the control signal; and wherein the lower mandrel 284 moves relative to the housing 278 in response to the inner threaded surface 282 traveling along the threaded outer surface 286 of the lower mandrel 284.

9. The downhole position adjustment assembly of claim 1, wherein the extend-retract mechanism includes:

a plurality of electromagnets 304 installed within the housing 308, wherein the electromagnets 304 are communicatively connected to the controller 138;

a plurality of permanent magnets 312 installed on an outer surface 316 of a lower mandrel 310, wherein the lower mandrel 310 is coupled to the mandrel 114;

wherein the lower mandrel 310 moves relative to the housing 308 in response to the plurality of permanent magnets 312 moving relative to the plurality of electromagnets, wherein the plurality of permanent magnets 312 move relative to the plurality of electromagnets 304 in response to the control signal.

10. The downhole position adjustment assembly of claim 1, further comprising:

a service packer 32 comprising a sealing element, a set of slips 42, a drag block assembly 44, and a packer actuation assembly comprising a lug and a j-track, wherein a first position of the lug in the j-track retains the service packer 32 in a run-in position and a second position of the lug in the j-track allows the service packer 32 to actuate; and wherein the service packer 32 is coupled to the housing 112, wherein the mandrel 114 is coupled to the housing 112 by the extend-retract mechanism.

11. The downhole position adjustment assembly of claim 10, wherein:

the packer actuation assembly includes a lug lock 158;

wherein the adjustment assembly abuts the lug lock 158 in the run-in position;

wherein the lug lock 158 retains the lug in the first position of the j-track; and wherein the lug lock 158 releases the lug from the first position of the j-track in response to the extend-retract mechanism moving the mandrel relative to the housing.

12. The downhole position adjustment assembly of claim 1, further comprising:

an anchoring mechanism 110 comprising a plurality of deployable anchors 146 housed within a plurality of deployment cylinders 152 coupled to the adjustment assembly;

wherein the plurality of deployable anchors 146 are extended from the deployment cylinders 152 in response to an extend signal from the controller 138;

wherein the extend signal generates one of i) a magnetic field generated at the bottom of the deployment cylinder, or ii) fluid pressure supplied by the pump 104; and wherein the deployable anchors 146 anchor to the inner surface 50 of the casing 20 in response to the extend signal from the controller 138.

13. A method of positioning a downhole tool assembly, comprising:

conveying a downhole tool coupled to an adjustment tool into a wellbore on a work string, wherein the adjustment tool comprises a mandrel, a housing, an extend-retract mechanism, wherein the extend-retract mechanism couples the mandrel to the housing, and wherein the downhole tool is coupled to the mandrel;

measuring a distance from the downhole tool to a target zone;

signaling the adjustment tool with a command signal; and moving the downhole tool from a first position to a second position located within the target zone in response to the mandrel moving relative to the housing, by the extend-retract mechanism, in response to the command signal; and unlocking a packer actuation assembly 180 on a service packer 170, wherein the packer actuation assembly 180 comprises a lug lock 158 in a first position retaining a lug in a run-in position within a j-slot, and wherein the mandrel moving relative to the housing moves the lug lock 158 to a second position, and wherein the lug is released to a second position within the j-slot in response to the lug lock 158 moving to the second position.

14. The method of claim 13 further comprising:

signaling an anchoring mechanism with a command signal, wherein the anchoring mechanism is coupled to the adjustment tool;

anchoring the adjustment tool to a location within the casing by extending a plurality of deployable anchors, from the anchoring mechanism; and wherein the deployable anchors are extended in response to the command signal.

15. The method of claim 13, further comprising:

extending the mandrel relative to the housing by the extend-retract mechanism; and setting a set of slips coupled to a service packer in response to a bottom part of the service packer moving upwards in response to the mandrel moving relative to the housing.

16. The method of claim 15, wherein:

setting a service packer comprises one of i) moving a lug in a j-slot from a first position to a second position by raising and lowering the work string, or ii) moving a lug in a j-slot to a second position by lowering the work string.

17. The method of claim 14, wherein the extend-retract mechanism is one of i) a hydraulic system with a volume of fluid and a pump, ii) a single pressure source with a manifold, iii) a gas generator with a manifold, iv) a motor driving a gear system, v) a motor turning a threaded extension, or vi) an electromagnetic extend-retract mechanism.

18. A downhole tool position adjustment assembly, comprising:

a mandrel 114 coupled to a housing 112 by an extend-retract mechanism, wherein actuation of the extend-retract mechanism moves the mandrel 114 relative to the housing 112;

a service packer 32 comprising a sealing element, a set of slips 42, a drag block assembly 44, and a packer actuation assembly comprising a lug and a i-track, wherein a first position of the lug in the i-track retains the service packer 32 in a run-in position and a second position of the lug in the i-track allows the service packer 32 to actuate, wherein the service packer 32 is coupled to the housing 112 and wherein the mandrel 114 is coupled to the housing 112 by the extend-retract mechanism;

a controller 138 communicatively connected to the extend-retract mechanism; and a communication system 140, communicatively connected to the controller 138 and configured to receive a command signal transmitted by an operator at a surface location, wherein the controller is configured to send a control signal to actuate the extend-retract mechanism in response to the command signal received by the communication system 140.

19. The downhole position adjustment assembly of claim 18, wherein the extend-retract mechanism includes:

a first chamber 102 formed between the mandrel 114, the housing 112, and a piston 164;

wherein the first chamber 102 is fluidly connected to a pump 104;

a second chamber 108 is fluidly connected to the pump 104;

wherein the pump 104 transfers fluid from the first chamber 102 to the second chamber 108 in response to the control signal; and wherein the mandrel 114 moves relative to the housing 112 in response to a decrease in volume of the first chamber 102 in response to the transfer of fluid from the first chamber 102.

20. The downhole position adjustment assembly of claim 19, wherein the pump 104 transfers fluid from the second chamber 108 to the first chamber 102 in response to the control signal, and wherein the mandrel 114 moves relative to the housing 112 in response to an increase in volume of the first chamber 102 in response to the transfer of fluid to the first chamber 102.

21. The downhole position adjustment assembly of claim 18, wherein the extend-retract mechanism includes:

a first chamber 102 formed between an upper mandrel 166, the housing 162, and a piston 164;

a second chamber 108 formed between a lower mandrel 168, the housing 162, and the piston 164, wherein the lower mandrel 168 is coupled to the mandrel 114;

wherein the first chamber 102 is fluidly connected to a manifold 210;

wherein the second chamber 108 is fluidly connected to the manifold 210;

a gas source 206, 222 fluidly connected to the manifold 210;

wherein the manifold 210 transfers fluid from the gas source 206 to the first chamber 102 and transfers fluid from the second chamber 108 to a bleed port in response to the control signal; and wherein the lower mandrel 168 moves relative to the housing 162 in response to an increase in volume of the first chamber 102 in response to the transfer of fluid from the gas source 206.

22. The downhole position adjustment assembly of claim 21, wherein the manifold 210 transfers fluid from the gas source 206 to the second chamber 108 and transfers fluid from the first chamber 102 to a bleed port in response to the control signal, and wherein the lower mandrel 168 moves relative to the housing 162 in response to an increase in volume of the second chamber 108 in response to the transfer of fluid from the gas source.

23. The downhole position adjustment assembly of claim 21, wherein the gas source 206 comprises a nitrogen source 206 or a gas generator 222.

24. The downhole position adjustment assembly of claim 18, wherein the extend-retract mechanism includes:

a motor 236 and a gear system 240 installed within the housing 234;

a threaded surface 244 of a lower mandrel 242 mechanically coupled to the gear system 240, wherein the lower mandrel 242 is coupled to the mandrel 114;

wherein the gear system 240 is rotationally connected to a motor 236;

wherein the gear system 240 travels along the threaded surface 244 of the lower mandrel 242 in response to the rotation of the gear system 240 by the motor 236 in response to the control signal, and wherein the lower mandrel 242 moves relative to the housing 234 in response to the gear system 240 traveling along the threaded surface 244.

25. The downhole position adjustment assembly of claim 18, wherein the extend-retract mechanism includes:

an inner threaded surface 282 of an end sub 280 coupled to the housing 278 threadingly coupled to a threaded outer surface 286 of a lower mandrel 284, wherein the lower mandrel 284 is coupled to the mandrel 114;

a gear system 268 mechanically coupled to a threaded surface 270 of the housing 278;

a motor 266 rotationally coupled to the gear system 268;

wherein the inner threaded surface 282, coupled to the housing 278, travels along the threaded outer surface 286 of the lower mandrel 284 in response to the rotation of the gear system 268 by the motor 266 in response to the control signal; and wherein the lower mandrel 284 moves relative to the housing 278 in response to the inner threaded surface 282 traveling along the threaded outer surface 286 of the lower mandrel 284.

26. The downhole position adjustment assembly of claim 18, wherein the extend-retract mechanism includes:

a plurality of electromagnets 304 installed within the housing 308, wherein the electromagnets 304 are communicatively connected to the controller 138;

a plurality of permanent magnets 312 installed on an-outer surface 316 of a lower mandrel 310, wherein the lower mandrel 310 is coupled to the mandrel 114;

wherein the lower mandrel 310 moves relative to the housing 308 in response to the plurality of permanent magnets 312 moving relative to the plurality of electromagnets, wherein the plurality of permanent magnets 312 move relative to the plurality of electromagnets 304 in response to the control signal.

27. The downhole position adjustment assembly of claim 21, wherein:

the packer actuation assembly includes a lug lock 158;

wherein the adjustment assembly abuts the lug lock 158 in the run-in position;

wherein the lug lock 158 retains the lug in the first position of the j-track; and wherein the lug lock 158 releases the lug from the first position of the j-track in response to the extend-retract mechanism moving the mandrel relative to the housing.

28. The downhole position adjustment assembly of claim 18, further comprising:

an anchoring mechanism 110 comprising a plurality of deployable anchors 146 housed within a plurality of deployment cylinders 152 coupled to the adjustment assembly;

wherein the plurality of deployable anchors 146 are extended from the deployment cylinders 152 in response to an extend signal from the controller 138;

wherein the extend signal generates one of i) a magnetic field generated at a bottom of the deployment cylinder, or ii) fluid pressure supplied by a pump 104; and wherein the deployable anchors 146 anchor to the inner surface 50 of a casing 20 in response to the extend signal from the controller 138.

* * * * *